US012129617B2

(12) United States Patent
Santha

(10) Patent No.: US 12,129,617 B2
(45) Date of Patent: Oct. 29, 2024

(54) FIBER SHEET SYSTEM

(71) Applicant: B. Lanka Santha, McDonough, GA (US)

(72) Inventor: B. Lanka Santha, McDonough, GA (US)

( * ) Notice: Subject to any disclaimer, the term of this patent is extended or adjusted under 35 U.S.C. 154(b) by 134 days.

(21) Appl. No.: 17/983,821

(22) Filed: Nov. 9, 2022

(65) Prior Publication Data

US 2023/0160166 A1 May 25, 2023

Related U.S. Application Data

(63) Continuation-in-part of application No. 17/859,445, filed on Jul. 7, 2022, now Pat. No. 11,965,301.

(60) Provisional application No. 63/361,070, filed on Nov. 23, 2021.

(51) Int. Cl.

| | |
|---|---|
| ***E02B 3/12*** | (2006.01) |
| ***E02D 17/20*** | (2006.01) |
| ***E02D 29/02*** | (2006.01) |

(52) U.S. Cl.

CPC ..... *E02B 3/125* (2013.01); *E02D 17/20* (2013.01); *E02D 2300/0067* (2013.01); *E02D 2600/30* (2013.01)

(58) Field of Classification Search

CPC ..... E02B 3/125; E02B 3/04; E02D 17/202; E02D 2300/0067; E02D 2300/0089; E02D 17/20; E01F 7/02; E01F 7/025

See application file for complete search history.

(56) References Cited

U.S. PATENT DOCUMENTS

| | | | |
|---|---|---|---|
| 3,973,355 | A | 8/1976 | McKenzie |
| 4,031,676 | A | 6/1977 | Dally |
| 4,434,576 | A | 3/1984 | Sowerwine |
| 4,926,587 | A | 5/1990 | van Wingerden |
| 4,960,349 | A | 10/1990 | Willibey et al. |
| 5,059,065 | A | 10/1991 | Doolaege |
| 5,091,247 | A | 2/1992 | Willibey et al. |
| 5,161,917 | A | 10/1992 | Papetti |
| 5,236,281 | A | 8/1993 | Middleton |
| 5,309,673 | A | 5/1994 | Stover et al. |
| 5,338,131 | A | 8/1994 | Bestmann |
| 5,421,123 | A | 6/1995 | Sakate et al. |
| 5,425,597 | A | 6/1995 | Bestmann |
| 5,595,458 | A | 1/1997 | Grabhorn |
| 5,605,416 | A | 2/1997 | Roach |
| 5,641,244 | A | 6/1997 | Bestmann |
| 5,651,641 | A | 7/1997 | Stephens et al. |
| 5,658,096 | A | 8/1997 | Von Kanel |

(Continued)

FOREIGN PATENT DOCUMENTS

| | | | |
|---|---|---|---|
| CA | 2882653 | A1 | 8/2015 |
| EP | 0480890 | A1 | 4/1992 |

(Continued)

*Primary Examiner* — Frederick L Lagman
*Assistant Examiner* — Stacy N Lawson
(74) *Attorney, Agent, or Firm* — Thomas B. McGurk

(57) ABSTRACT

A fiber sheet system suitable for controlling erosion and stabilizing soil is described that comprises a fiber sheet comprising a natural fiber felt. A coating composition comprising a natural rubber is adhered to the fiber sheet. The fiber sheet has a top side width less than the height and the length of the fiber sheet. A netting contacts the front and rear sides of the fiber sheet.

8 Claims, 15 Drawing Sheets

(56) References Cited

U.S. PATENT DOCUMENTS

| | | | |
|---|---|---|---|
| 5,678,954 | A | 10/1997 | Bestmann |
| 5,735,640 | A | 4/1998 | Meyer et al. |
| 5,951,202 | A | 9/1999 | Brown |
| 5,997,213 | A | 12/1999 | Dennis et al. |
| 6,109,835 | A | 8/2000 | Grabhorn |
| 6,127,027 | A | 10/2000 | Nogami et al. |
| 6,168,349 | B1 | 1/2001 | Perslow et al. |
| 6,234,721 | B1 | 5/2001 | Cronkhite et al. |
| 6,267,533 | B1 | 7/2001 | Bourg |
| 6,547,493 | B2 | 4/2003 | Spangler et al. |
| 6,616,383 | B2 | 9/2003 | Janz |
| 6,709,202 | B2 | 3/2004 | Spangler et al. |
| 6,893,193 | B2 | 5/2005 | Santha |
| 6,910,835 | B2 | 6/2005 | Spangler et al. |
| 7,029,208 | B1 | 4/2006 | Santha |
| 8,740,503 | B1 | 6/2014 | Tyler |
| 9,057,168 | B1 | 6/2015 | Dugan, Jr. |
| 9,315,962 | B2 | 4/2016 | Santha |
| 9,387,983 | B2 | 7/2016 | Happy et al. |
| 10,280,578 | B2 | 5/2019 | Santha |
| 10,648,149 | B1 | 5/2020 | Santha |
| 2002/0073616 | A1 | 6/2002 | Pelton |
| 2003/0017000 | A1 | 1/2003 | Jansson |
| 2003/0143026 | A1 | 7/2003 | Santha |
| 2004/0005198 | A1 | 1/2004 | Spangler |
| 2004/0202851 | A1* | 10/2004 | Goodrum ..... B32B 5/26 442/381 |
| 2014/0050527 | A1 | 2/2014 | Kelsey et al. |
| 2015/0240438 | A1 | 8/2015 | Santha |
| 2017/0204582 | A1 | 7/2017 | Allard |
| 2019/0055706 | A1 | 2/2019 | Santha |

FOREIGN PATENT DOCUMENTS

| | | | |
|---|---|---|---|
| JP | 359126824 | A | 7/1984 |
| JP | 403055316 | A | 3/1991 |
| JP | 403233021 | A | 10/1991 |
| JP | 406212609 | A | 8/1994 |
| KR | 100829171 | B1 * | 5/2008 |
| KR | 100873158 | B1 * | 12/2008 |

* cited by examiner

FIBER SHEET SYSTEM

CROSS REFERENCE TO RELATED APPLICATIONS

This application is a continuation-in-part application of U.S. Non-Provisional patent application Ser. No. 17/859,445, entitled "Fiber Sheet System", filed on Jul. 7, 2022, which claimed priority to U.S. Provisional Patent Application Ser. No. 63/361,070, entitled "Improved Fiber Block System" filed. Nov. 23, 2021. This application claims priority to both U.S. Provisional Patent Application Ser. No. 63/361,070, entitled "Improved Fiber Block System", filed Nov. 23, 2021, and U.S. Non-Provisional patent application Ser. No. 17/859,445, entitled "Fiber Sheet System", filed Jul. 7, 2022, both of which are hereby incorporated by reference in their entirety herein to provide continuity of disclosure.

BACKGROUND

Conventional forms of wattles and logs used for perimeter sediment control, slope length shortening, and check dam applications are generally thick and circular in cross section. The circular structure results from the method of construction in which a tubular sleeve of netting is stuffed with filler from one end. When installed, less than the entire diameter of the circular log will contact the ground due to its shape, resulting in performance issues that require additional installation steps to address. Water tends to flow between the ground and convention cylindrical wattles and logs since they lack sufficient contact and downward pressure to form adequate barriers to water flow. The additional installation steps that are sometimes taken with conventional wattles and logs can include the digging of trenches and the extensive use of ropes to anchor the circular wattles and logs in place. Use of anchoring ropes tends to result in water flowing between the circular log and the rope, thereby undercutting the log and at least partially defeating the purpose thereof. Furthermore, the performance efficiency per unit of weight of a conventional wattle log is not optimal due to the log being wider in diameter than the diameter of the portion thereof that actually contacts the ground.

Additionally, the thickness and shape of conventional wattle logs make them difficult to configure for transporting and storage. The thickness of conventional wattle logs and fiber blocks relative to their height results in a relatively small number of linear meters of sediment control barrier that can be arranged on a pallet for shipping and/or storage. As a result, many pallets of conventional wattle logs and fiber blocks must be used to accommodate a target length of sediment control barriers.

Furthermore, transportation and handling costs represent a significant portion of the overall costs of a sediment control system. These transportation and handling costs are affected by the total volume of a sediment control barrier required to address a given situation. Consequently, reducing the unit volume per unit length of a sediment control system may advantageously impact the costs of transportation and handling the sediment control system.

Consequently, there is a need for a system that provides for perimeter sediment control, slope length shortening, and check dam applications that can address one or more of these and other shortcomings.

SUMMARY

The present disclosure encompasses a fiber sheet system for perimeter sediment control, slope length shortening, and check dam applications comprising: a fiber sheet comprising, consisting essentially of, or consisting of a natural fiber felt, wherein the fiber sheet comprises a top side, a bottom side opposing the top side, a front side extending between the top side and the bottom side, a rear side opposing the front side and extending between the top side and the bottom side, a right side extending between the front side and the rear side, and a left side opposing the right side; a coating composition adhered to the fiber sheet, wherein the coating composition comprises, consists essentially of, or consists of a natural rubber, wherein the natural rubber comprises, consists essentially of, or consists of a polyisoprene moiety; and, a netting attached to the fiber sheet, wherein the netting comprises, consists essentially of, or consists of a natural fiber mesh.

In one aspect, the fiber sheet comprises a ratio of a front side height of the front side of the fiber sheet to a top side width of the top side of the fiber sheet in a range of about 9 to 1 to about 90 to 1. In another aspect, the coating composition is adhered to the rear side of the fiber sheet. In a further aspect, the coating composition is adhered to the front side of the fiber sheet. In yet another aspect, the coating composition exhibits an area density in the range of about 0.06 $kg/m^2$ to about 0.22 $kg/m^2$. In still a further aspect, the coating composition exhibits an area density in the range of about 0.07 $kg/m^2$ to about 0.1 $kg/m^2$. In still another aspect, the fiber sheet comprises a fiber sheet upper section and a fiber sheet lower section, wherein the fiber sheet upper section is covered by the netting, and wherein the fiber sheet lower section extends beyond a lower edge of the netting. In one aspect, the netting comprises a band, wherein the band is aligned adjacent the lower edge of the netting. In still another aspect, the coating composition is cross-linked with the natural fiber felt. In a further aspect, the netting comprises a front side netting section and a rear side netting section, wherein the front side netting section contacts the front side of the fiber sheet, wherein the rear side netting section contacts the rear side of the fiber sheet, wherein the front side netting section exhibits a front side netting thread count, and wherein the rear side netting section exhibits a rear side netting thread count, and wherein the rear side netting thread count is greater than then the front side netting thread count. In another aspect, the rear side netting comprises a plurality of rear side netting bands. In still a further aspect, the netting comprises a sleeve encasing the fiber sheet. In another aspect, the natural fiber felt comprises, consists essentially of, or consists of coir fibers. In one aspect, the netting comprises, consists essentially of, or consists of a coir twine. In another aspect, the fiber sheet system comprises a plurality of stakes connected to the netting and aligned adjacent the fiber sheet.

The present disclosure also encompasses a fiber sheet system for perimeter sediment control, slope length shortening, and check dam applications comprising: a fiber sheet comprising, consisting essentially of, or consisting of a natural fiber felt, wherein the fiber sheet comprises a top side, a bottom side opposing the top side, a front side extending between the top side and the bottom side, a rear side opposing the front side and extending between the top side and the bottom side, a right side extending between the front side and the rear side, and a left side opposing the right side, wherein a ratio of a front side height of the front side of the fiber sheet to a top side width of the top side of the fiber sheet is in a range of about 9 to 1 to about 90 to 1; a coating composition adhered to the fiber sheet, wherein the coating composition comprises, consists essentially of, or consists of a natural rubber; and, a netting covering the fiber sheet, wherein the netting comprises a natural fiber mesh.

In one aspect, the coating composition is adhered to the rear side of the fiber sheet. In another aspect, the coating composition is adhered to the front side of the fiber sheet. In a further aspect, the coating composition exhibits an area density in the range of about 0.07 kg/m$^2$ to about 0.1 kg/m$^2$.

The present disclosure further encompasses a fiber sheet system for perimeter sediment control, slope length shortening, and check dam applications comprising a fiber sheet comprising, consisting essentially of, or consisting of coir fiber felt, wherein the fiber sheet comprises a top side, a bottom side opposing the top side, a front side extending between the top side and the bottom side, a rear side opposing the front side and extending between and connected to the top side and the bottom side, a right side, and a left side opposing the right side, wherein the fiber sheet comprises, consists essentially of, or consists of a coir fiber felt, and wherein a ratio of a front side height of the front side of the fiber sheet to a top side width of the top side of the fiber sheet is in a range of about 9 to 1 to about 90 to 1; a coating composition adhered to the fiber sheet, wherein the coating composition comprises, consists essentially of, or consists of a natural rubber, wherein the natural rubber comprises, consists essentially of, or consists of a polyisoprene moiety, wherein the coating composition exhibits an area density in the range of about 0.07 kg/m$^2$ to about 0.1 kg/m$^2$, and, a netting contacting the fiber sheet, wherein the netting comprises a sleeve, wherein the sleeve encases the fiber sheet, and wherein the sleeve comprises, consists essentially of, or consists of coir fibers.

These and other aspects of the present disclosure are set forth in greater detail below and in the drawings for which a brief description is provided as follows.

DETAILED DESCRIPTION

Figure 1:
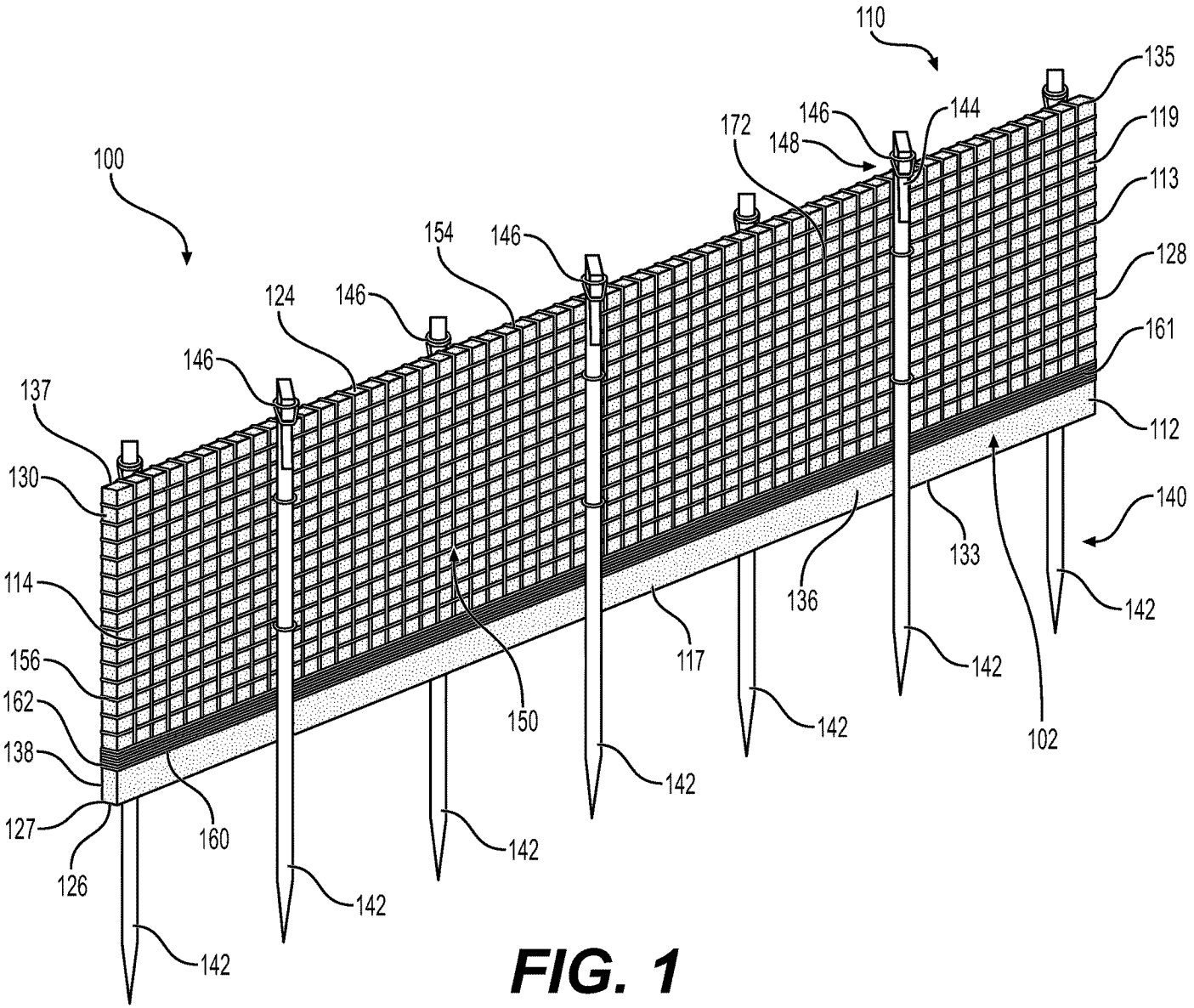
FIG. 1 is a perspective view of a portion of a fiber sheet system including a fiber sheet system segment of the fiber sheet system, wherein the fiber sheet system and the fiber sheet system segment encompass aspects of the present disclosure.
Figure 2:
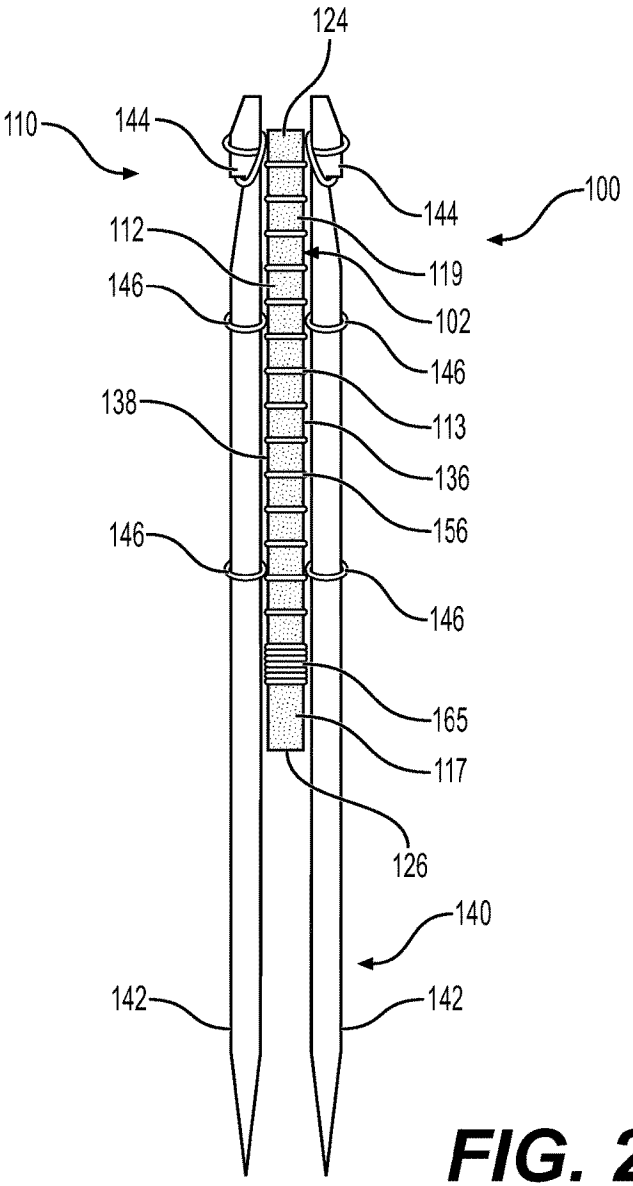
FIG. 2 is a left side view of the portion of the fiber sheet system shown in FIG. 1.
Figure 3:
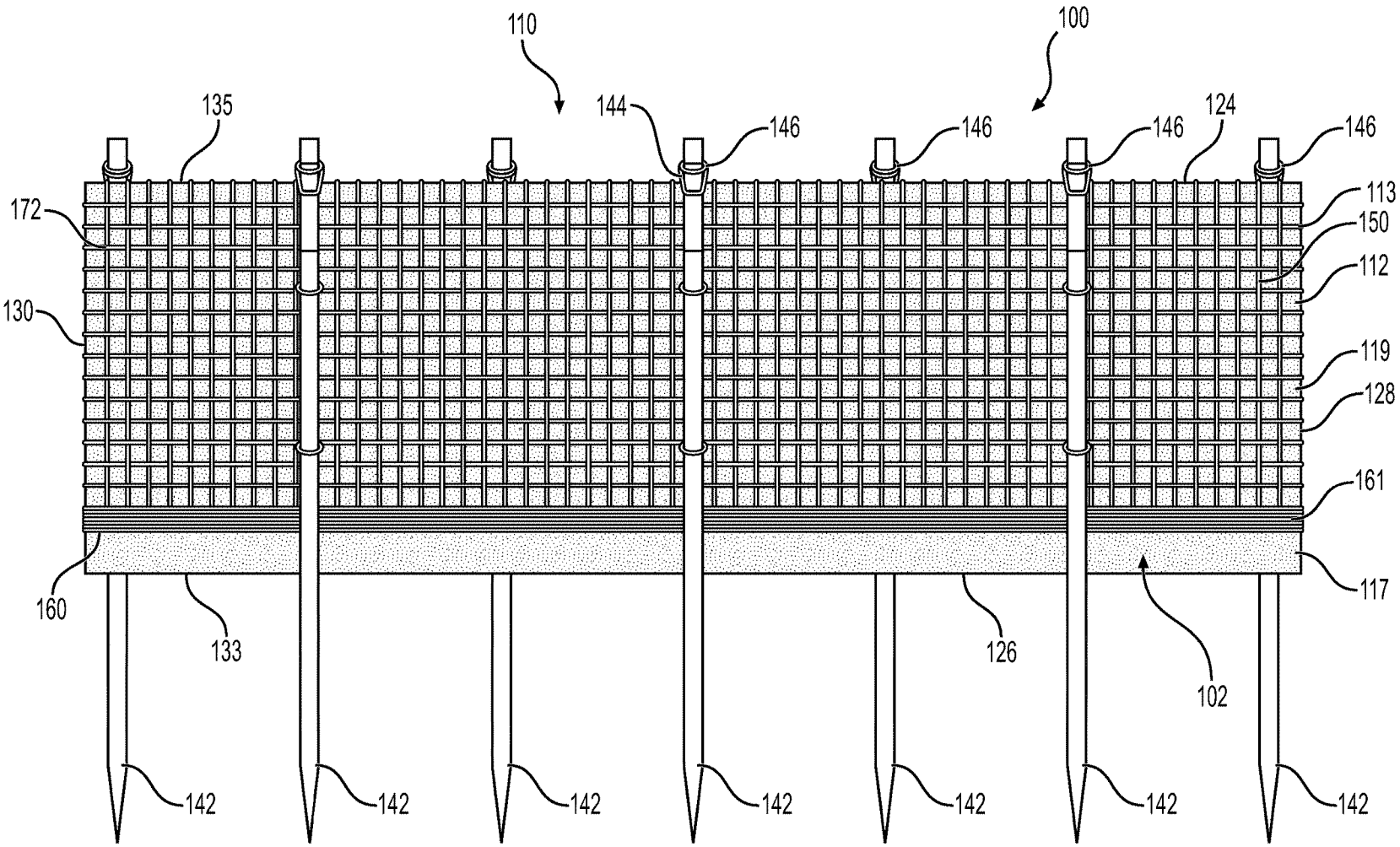
FIG. 3 is a front side view of the portion of the fiber sheet system shown in FIG. 1.
Figure 4:
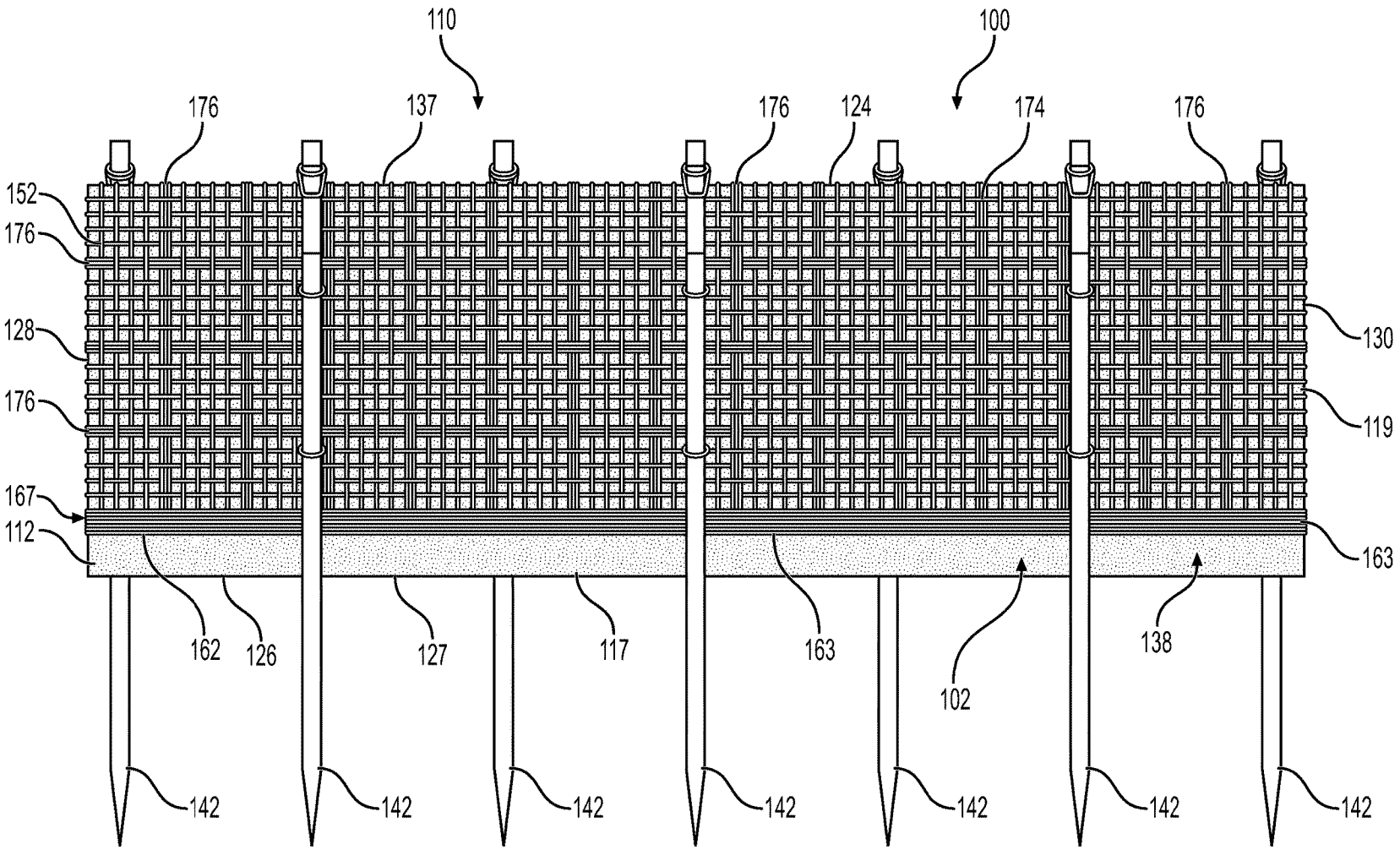
FIG. 4 is a rear side view of the portion of the fiber sheet system shown in FIG. 1.

The present disclosure encompasses fiber sheet systems, fiber sheet system segments and fiber sheets having coating compositions adhered thereto and that can be used in applications for erosion and sediment control, perimeter sediment control, slope length shortening, and/or check dam formation. The present disclosure refers in detail below to various aspects of the fiber sheet systems, the fiber sheet system segments, and the fiber sheets that are illustrated in the accompanying drawings. Wherever possible, the application uses the same reference numbers throughout the drawings to refer to the same or similar items.

As used herein, the singular forms of "a," "an," and "the" encompass the plural forms thereof unless otherwise indicated. As used herein, the phrase "at least one" includes all numbers of one and greater. As used herein, the term "and/or" refers to one or all of the listed elements or a combination of any two or more of the listed elements. As used herein, the phrase "integrally formed" means formed as a single, unitary body. As used herein, the term "felt" refers to a body of nonwoven fibers formed by pressure and/or other means of fiber entanglement, such as heat, moisture, and/or needle-punching. As used herein, the term "thread count" refers to the total number of warp and weft threads combined in one square centimeter of netting. As used herein, the term "cross-link" means a reaction that results in a chemical bond, such as a covalent bond, ionic bond, or hydrogen bond, between the chains of different molecules or polymers. As used herein, the term "adhere" refers to the mechanical, chemical, electrostatic, and/or dispersive joining of one material or component to another.

The fiber sheet systems, the fiber sheet system segments, and the fiber sheets encompassed by the present disclosure can comprise thin sheets of entangled and compressed natural fibers having adhered thereto a coating composition comprising natural rubber derived from natural latex. The coated fiber sheets are ecologically friendly and can aid in erosion and sediment control, perimeter sediment control, slope length shortening, and/or check dam applications. Because the fiber sheet systems and fiber sheet system segments comprise natural fibers and natural coatings, they can be installed in environmentally sensitive areas. Surprisingly, the fiber sheet systems, the fiber sheet system segments, and the coated fiber sheets encompassed by the present disclosure can capture sediment contained in ground water even though the coated fiber sheets of the fiber sheet systems are relatively thin in width as compared to their heights and lengths.

The fiber sheet systems encompassed by the present disclosure can comprise one or more fiber sheet system segments, and/or one or more coated fiber sheets as described herein aligned alone, end to end with other fiber sheet system segments and/or other coated fiber sheets, and/or side by side with other fiber sheet system segments and/or other coated fiber sheets to provide a barrier of sufficient length and width to achieve the intended goals. The fiber sheet systems, the fiber sheet system segments, and the coated fiber sheets can aid in the protection from erosion of bare soil. Among the natural fibers that can be used in the fiber sheets, nettings, sleeves, meshes, and ties of the fiber sheet systems is coconut or coir fiber, which can be used to form any one or more of these components and provide the desired characteristics of the systems.

FIGS. 1-9 illustrate a portion of a fiber sheet system 100 and a fiber sheet system segment 110 encompassing aspects of the present disclosure. As shown in FIG. 1, the fiber sheet system segment 110 of the fiber sheet system 100 comprises a fiber sheet 112 formed of needle-punched coir fiber felt 121 covered at least partially by a netting 113 of a high strength mesh 114 that contacts each of the sides of the fiber sheet 112. A coating composition 102 is adhered to at least one side, such as the front side 136, of the fiber sheet 112. The mesh 114 can comprise natural fibers, such as coir fibers, other biodegradable fibers, or of twine made exclusively of natural fibers, or, alternatively, made with biodegradable natural fibers wrapped around a synthetic core. In one aspect, both the fiber sheet 112 and the mesh 114 comprise, consist essentially of or consist of coir fibers.

The fiber sheet 112 is an elongated rectangular sheet. The fiber sheet 112 comprises a top side 124, a bottom side 126 opposite the top side 124, a front side 136 extending between the top side 124 and the bottom side 126, a rear side 138 opposing the front side 136 and also extending between the top side 124 and the bottom side 126, a left side 130 extending between the front side 136 and the rear side 138, and a right side 128 opposing the left side 130 and also extending between the front side 136 and the rear side 138. The rear side 138 and the front side 136 are the major sides of the fiber sheet 112, while the top side 124, the bottom side 126, the left side 130 and the right side 128 are the minor sides of the fiber sheet 112. The major sides, the rear side 138 and the front side 136, are substantially greater in area than the minor sides, the top side 124, the bottom side 126, the left side 130 and the right side 128. The fiber sheet 112 comprises a needle-punched coir fiber felt 121. The minor sides are the thickness or width of the elongated sheet of needle-punched coir fiber felt 121.

The top side 124 and the front side 136 cooperate to define a upper front edge 135. The bottom side 126 and the front side 136 cooperate to define a lower front edge 133. The top side 124 and the rear side 138 cooperate to define an upper rear edge 137, and the bottom side 126 and the rear side 138 cooperate to define a lower rear edge 127. The front side 136 and the rear side 138 are generally rectangular. The top side 124, the front side 136, the rear side 138, and the bottom side 126 are generally flat and extend the length of the fiber sheet 112 between the left side 130 and the right side 128.

In one aspect, the fiber sheet 112 comprises, consists essentially of, or consists of a needle-punched coir fiber felt 121. The coir fiber felt 121 is formed by feeding loose coir fibers through a needle punch machine to compress and entangle the loose coir fibers into a dense interconnected coir fiber felt. The coir fibers become entangled during the needle-punching process, thereby resulting in the formation of a nonwoven coir fiber felt 121. The coir fiber felt 121 is substantial and rigid enough to make the fiber sheet 112 free standing when properly aligned.

The coir fiber felt 121 of the fiber sheet 112 can exhibit a density in the range of about 100 kg/m$^3$ to about 125 kg/m$^3$. In another aspect, the coir fiber felt 121 of the fiber sheet 112 can exhibit density that is about 112 kg/m. In one aspect, the upper limit of the range of density exhibited by the coir fiber felt 121 of the fiber sheet 112 can be about 112 kg/m$^3$, 113 kg/m$^3$, 114 kg/m$^3$, 115 kg/m$^3$, 116 kg/m$^3$, 117 kg/m$^3$, 118 kg/m$^3$, 119 kg/m$^3$, 120 kg/m$^3$, 121 kg/m$^3$, 122 kg/m$^3$, 123 kg/m, 124 kg/m$^3$, or 125 kg/m$^3$. In a further aspect, the lower limit of the range of density exhibited by the coir fiber felt of the fiber sheet 112 can be about 100 kg/m$^3$, 101 kg/m$^3$, 101 kg/m$^3$, 102 kg/m$^3$, 103 kg/m$^3$, 104 kg/m$^3$, 105 kg/m$^3$, 106 kg/m$^3$, 107 kg/m$^3$, 108 kg/m$^3$, 109 kg/m$^3$, 110 kg/m$^3$, 111 kg/m$^3$, or 112 kg/m$^3$.

The fiber sheet 112 can also be described in terms of its mass per unit area, or area density. The coir fiber felt 121 of the fiber sheet 112 can exhibit an area density in the range of about 1.25 kg/m$^2$ to about 1.56 kg/m$^2$. The coir fiber felt 121 of the fiber sheet 112 can exhibit an area density of about 1.4 kg/m$^2$. In one aspect, the lower limit of the range of the area density exhibited by the coir fiber felt 121 of the fiber sheet 112 can be about 1.25 kg/m$^2$, 1.26 kg/m$^2$, 1.27 kg/m$^2$, 1.28 kg/m$^2$, 1.29 kg/m$^2$, 1.30 kg/m$^2$, 1.31 kg/m$^2$, 1.32 kg/m$^2$, 1.33 kg/m$^2$, 1.34 kg/m$^2$, 1.35 kg/m$^2$, 1.36 kg/m$^2$, 1.37 kg/m$^2$, 1.38 kg/m$^2$, 1.39 kg/m$^2$, or 1.4 kg/m$^2$. In a further aspect, the upper limit of the range of the area density exhibited by the coir fiber felt 121 of the fiber sheet 112 can be about 1.4 kg/m$^2$, 1.41 kg/m$^2$, 1.42 kg/m$^2$, 1.43 kg/m$^2$, 1.44 kg/m$^2$, 1.45 kg/m$^2$, 1.46 kg/m$^2$, 1.47 kg/m$^2$, 1.48 kg/m$^2$, 1.49 kg/m$^2$, 1.50 kg/m$^2$, 1.51 kg/m$^2$, 1.52 kg/m$^2$, 1.53 kg/m$^2$, 1.54 kg/m$^2$, 1.55 kg/m$^2$, or 1.56 kg/m$^2$.

In one aspect, the coating composition 102 comprises a natural latex. The natural latex comprises a natural rubber. The natural rubber is a polymer of isoprene, also known as 2-methyl-1,3-butadiene. In another aspect, the coating composition 102 comprises a natural rubber. In another aspect, the coating composition 102 comprises a polyisoprene moiety. In yet another aspect, the coating composition 102 comprises greater than 50% by weight of a natural rubber. The coating composition 102 can be formed from a natural latex, such as a Low Ammonia Centrifuged Latex available from SL Coco Fibre Manufacturing Co. (Pvt.) Ltd., Ihala Baladora, Kobeygane, Sri Lanka. The natural latex can comprise about 60% by weight or greater of a natural rubber, cis 1,4 polyisoprene.

In one aspect, the coating composition 102 can comprise a natural rubber in a range of about 10% to about 95% by weight. In another aspect, the coating composition 102 can comprise a natural rubber in a range of about 30% to about 80% by weight. In a further aspect, the coating composition 102 can comprise greater than 50% by weight of a natural rubber. In yet another aspect, the coating composition 102 can comprise greater than 60% by weight of a natural rubber. In still a further aspect, the coating composition can comprise greater than 75% by weight of a natural rubber.

In one aspect, the lower limit of the range of percentage amount by weight of the natural rubber of the coating composition 102 can be about 10%, 11%, 12%, 13%, 14%, 15%, 16%, 17%, 18%, 19%, 20%, 21%, 22%, 23%, 24%, 25%, 26%, 27%, 28%, 29%, 30%, 31%, 32%, 33%, 34%, 35%, 36%, 37%, 38%, 39%, 40%, 41%, 42%, 43%, 44%, 45%, 46%, 47%, 48%, 49%, 50%, 51%, 52%, 53%, 54%, 55%, 56%, 57%, 58%, 59%, 60%, 61%, 62%, 63%, 64%, 65%, 66%, 67%, 68%, 69%, 70%, 71%, 72%, 73%, 74%, 75%, 76%, 77%, 78%, 79%, or 80%.

In another aspect, the upper limit of the range of percentage amount by weight of the natural rubber of the coating composition 102 can be about 30%, 31%, 32%, 33%, 34%, 35%, 36%, 37%, 38%, 39%, 40%, 41%, 42%, 43%, 44%, 45%, 46%, 47%, 48%, 49%, 50%, 51%, 52%, 53%, 54%, 55%, 56%, 57%, 58%, 59%, 60%, 61%, 62%, 63%, 64%, 65%, 66%, 67%, 68%, 69%, 70%, 71%, 72%, 73%, 74%, 75%, 76%, 77%, 78%, 79%, 80%, 81%, 82%, 83%, 84%, 85%, 86%, 87%, 88%, 89%, 90%, 91%, 92%, 93%, 94%, 95%, 96%, 97%, 98%, or 99%.

The coating composition 102 also can be described in terms of its mass per unit area, or area density. The coating composition 102 adhered to the fiber sheet 112 can exhibit an area density in the range of about 0.05 kg/m$^2$ to about 0.3 kg/m$^2$. The coating composition 102 on the fiber sheet 112 can exhibit an area density of about 0.07 kg/m$^2$.

In one aspect, the lower limit of the range of the area density exhibited by the coating composition on the fiber sheet 112 can be about 0.05 kg/m$^2$, 0.06 kg/m$^2$, 0.07 kg/m$^2$, 0.08 kg/m$^2$, 0.08 kg/m$^2$, 0.09 kg/m$^2$, 0.1 kg/m$^2$, 0.11 kg/m$^2$, 0.12 kg/m$^2$, 0.13 kg/m$^2$, 0.14 kg/m$^2$, 0.15 kg/m$^2$, 0.16 kg/m$^2$, 0.17 kg/m$^2$, 0.18 kg/m$^2$, 0.19 kg/m$^2$, 0.2 kg/m$^2$, 0.21 kg/m$^2$, 0.22 kg/m$^2$, 0.23 kg/m$^2$, 0.24 kg/m$^2$, 0.25 kg/m$^2$, 0.26 kg/m$^2$, 0.27 kg/m$^2$, 0.28 kg/m$^2$, or 0.29 kg/m$^2$.

In a further aspect, the upper limit of the range of the area density exhibited by the coating composition 102 on the fiber sheet 112 can be about 0.06 kg/m$^2$, 0.07 kg/m$^2$, 0.08 kg/m$^2$, 0.08 kg/m$^2$, 0.09 kg/m$^2$, 0.1 kg/m$^2$, 0.11 kg/m$^2$, 0.12 kg/m$^2$, 0.13 kg/m$^2$, 0.14 kg/m$^2$, 0.15 kg/m$^2$, 0.16 kg/m$^2$, 0.17 kg/m$^2$, 0.18 kg/m$^2$, 0.19 kg/m$^2$, 0.2 kg/m$^2$, 0.21 kg/m$^2$, 0.22 kg/m$^2$, 0.23 kg/m$^2$, 0.24 kg/m$^2$, 0.25 kg/m$^2$, 0.26 kg/m$^2$, 0.27 kg/m$^2$, 0.28 kg/m$^2$, 0.29 kg/m$^2$, or 0.3 kg/m$^2$.

The fiber sheet 112 can also be described in terms of its mass per unit area, or area density. The coir fiber felt 121 of the fiber sheet 112 can exhibit an area density in the range of about 1.25 kg/m$^2$ to about 1.56 kg/m$^2$. The coir fiber felt 121 of the fiber sheet 112 can exhibit an area density of about 1.4 kg/m$^2$. In one aspect, the lower limit of the range of the area density exhibited by the coir fiber felt 121 of the fiber sheet 112 can be about 1.25 kg/m$^2$, 1.26 kg/m$^2$, 1.27 kg/m$^2$, 1.28 kg/m$^2$, 1.29 kg/m$^2$, 1.30 kg/m$^2$, 1.31 kg/m$^2$, 1.32 kg/m$^2$, 1.33 kg/m$^2$, 1.34 kg/m$^2$, 1.35 kg/m$^2$, 1.36 kg/m$^2$, 1.37 kg/m$^2$, 1.38 kg/m$^2$, 1.39 kg/m$^2$, or 1.4 kg/m$^2$. In a further aspect, the upper limit of the range of the area density exhibited by the coir fiber felt 121 of the fiber sheet 112 can be about 1.4 kg/m$^2$, 1.41 kg/m$^2$, 1.42 kg/m$^2$, 1.43 kg/m$^2$, 1.44 kg/m$^2$, 1.45 kg/m$^2$, 1.46 kg/m$^2$, 1.47 kg/m$^2$, 1.48 kg/m$^2$, 1.49 kg/m$^2$, 1.50 kg/m$^2$, 1.51 kg/m$^2$, 1.52 kg/m$^2$, 1.53 kg/m$^2$, 1.54 kg/m$^2$, 1.55 kg/m$^2$, or 1.56 kg/m$^2$.

In a further aspect, the upper limit of the range of the area density exhibited by the coir fiber felt 121 of the fiber sheet 112 can be about 1.4 kg/m$^2$, 1.41 kg/m$^2$, 1.42 kg/m$^2$, 1.43 kg/m$^2$, 1.44 kg/m$^2$, 1.45 kg/m$^2$, 1.46 kg/m$^2$, 1.47 kg/m$^2$, 1.48 kg/m$^2$, 1.49 kg/m$^2$, 1.50 kg/m$^2$, 1.51 kg/m$^2$, 1.52 kg/m$^2$, 1.53 kg/m$^2$, 1.54 kg/m$^2$, 1.55 kg/m$^2$, or 1.56 kg/m$^2$.

As shown in FIGS. 1-4, the fiber sheet system 100 can comprise a plurality of stakes 140 positioned adjacent both the rear side 138 and the front side 136 of the fiber sheet system segment 110. Each stake 142 of the plurality of stakes 140 can be connected to the fiber sheet system segment 110 by one or more anchor ties 146 that loop around each stake 142. The anchor ties 146 are attached to and/or integrally formed with the netting 113 and can be formed of the same coir fiber twine of which the mesh 114 of the netting 113 is formed. Each stake 142 can include a notch 144 formed therein through which an anchor tie 146 can be looped or threaded. The fiber sheet system segment 110 can be firmly positioned in place by securely cinching an anchor tie 146 through the notch 144 of a stake 142. Each stake 142 can be positioned directly adjacent to the rear side 138 or the front side 136 and spaced apart from the other stakes 142 so as to provide support system for the fiber sheet system segment 110 across the length of the fiber sheet 112. As each stake 142 is driven into the ground, the anchor tie 146 that is engaged with the notch 144 of the stake 142, which is pulled downward by the stake 142, thereby pulling the netting 113 and the fiber sheet system segment 110 downward with the anchor tie 146 to secure the fiber sheet system segment 110 to the ground.

Figure 5:
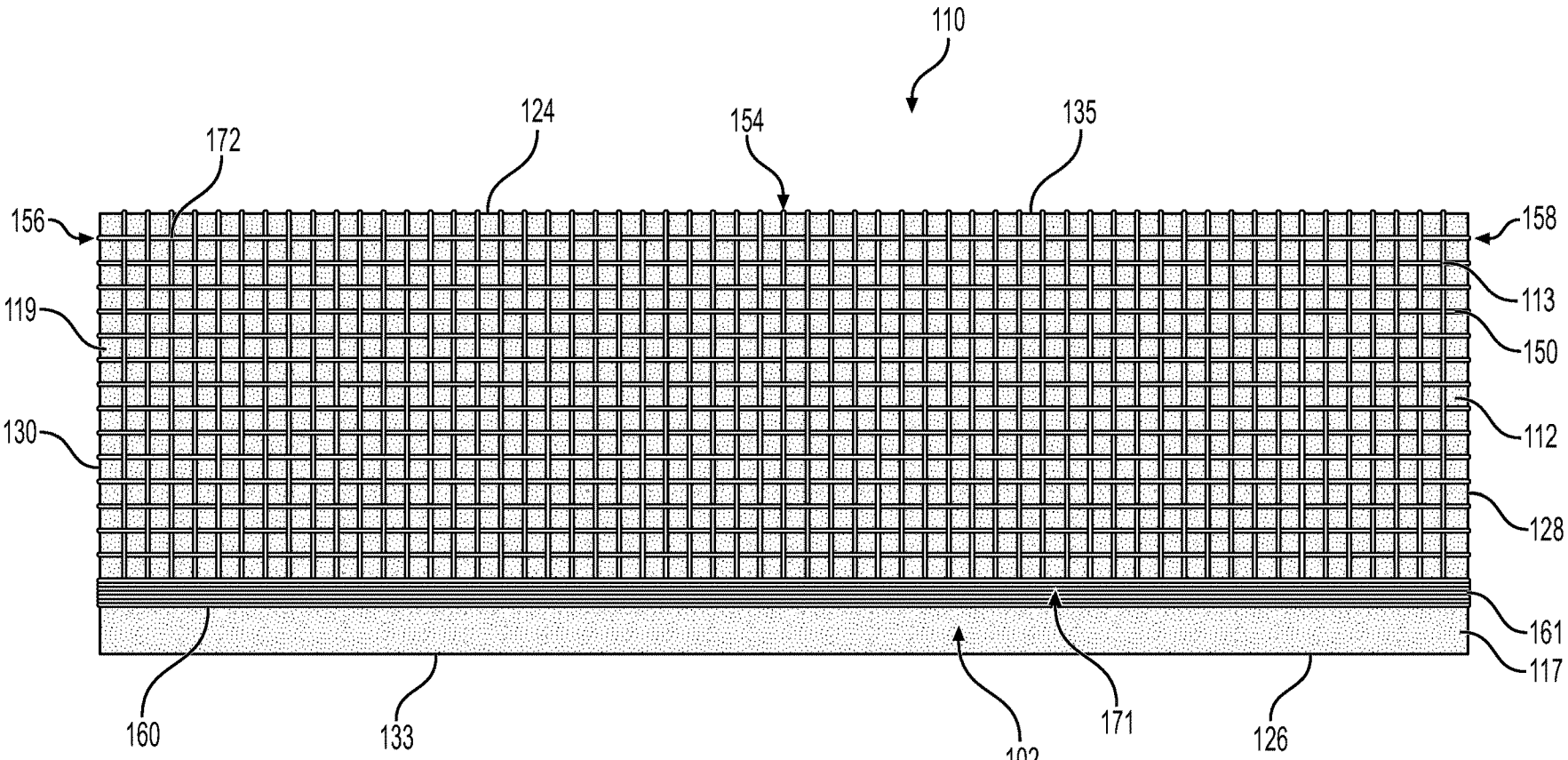
FIG. 5 is a front side view of the fiber sheet system segment of the fiber sheet system shown in FIG. 1 with the plurality of stakes removed.
Figure 6:
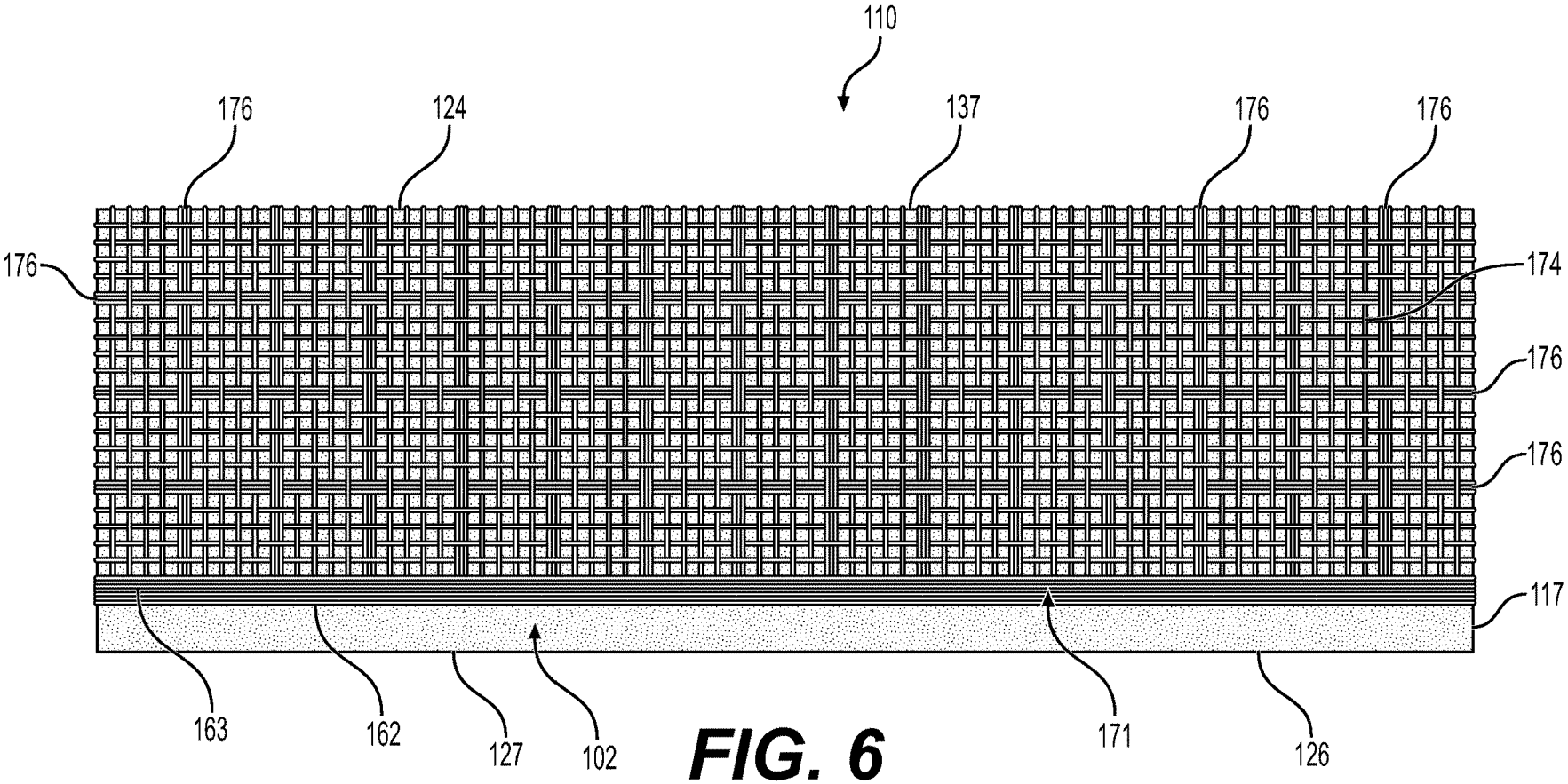
FIG. 6 is a rear side view of the fiber sheet system segment shown in FIG. 5.
Figure 7:
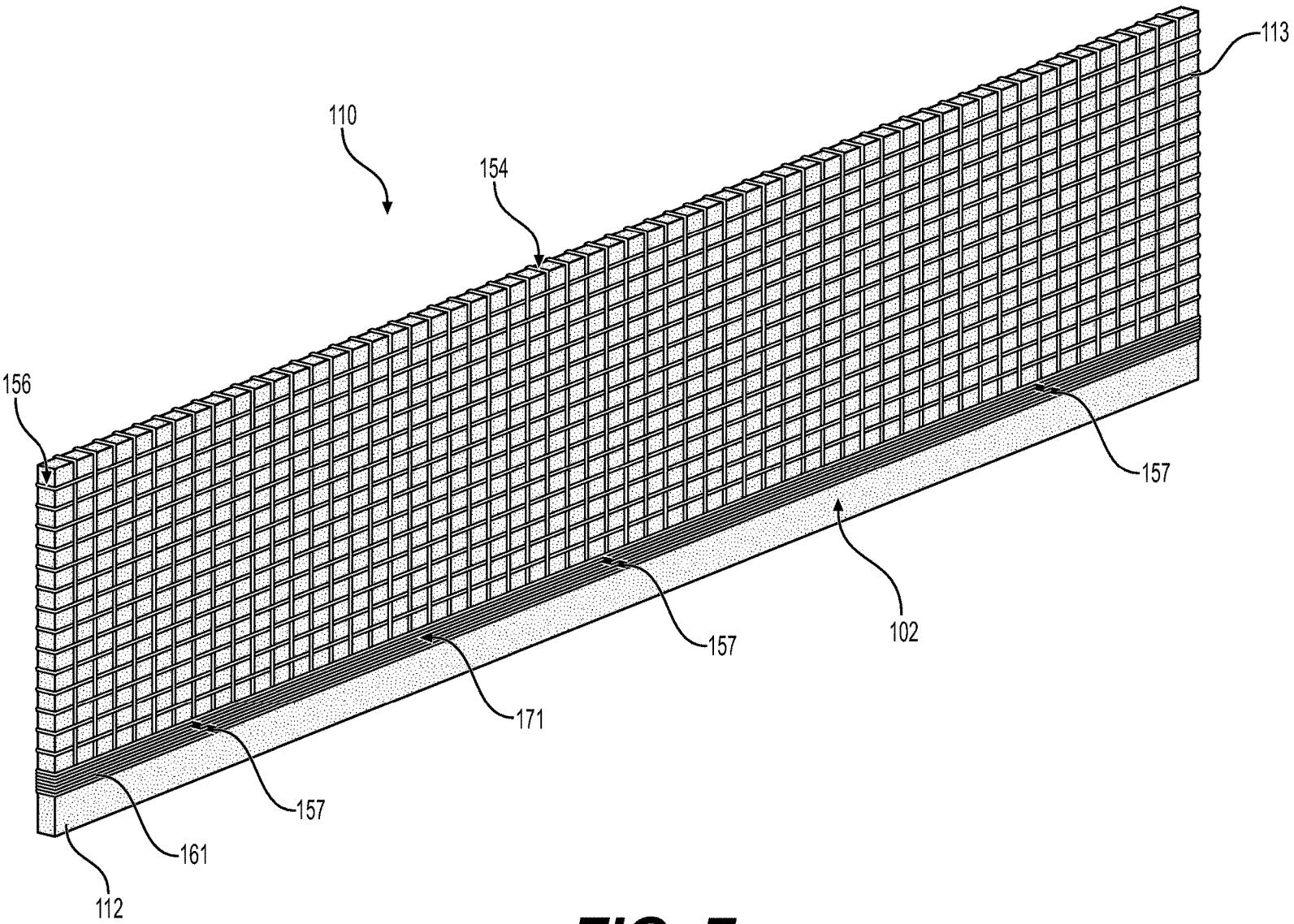
FIG. 7 is a perspective view of the fiber sheet system segment shown in FIG. 5 showing cross-ties in dashed line, wherein the cross-ties extend through the fiber sheet.
Figure 8:
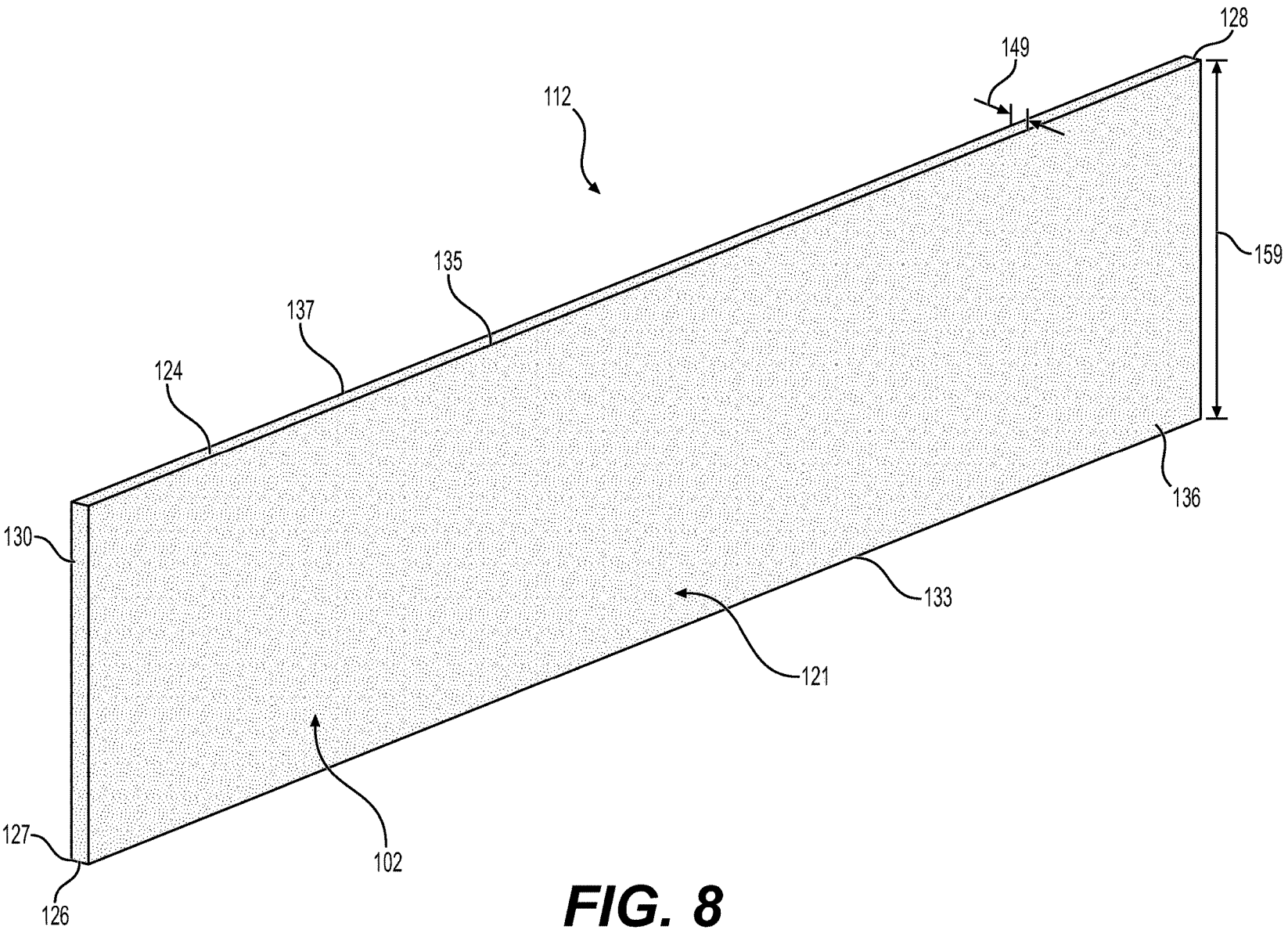
FIG. 8 is a perspective view of the fiber sheet of the portion of the fiber sheet system shown in FIG. 1 with the outer netting and the plurality of stakes removed.

FIGS. 5-7 illustrate the fiber sheet system segment 110 of the fiber sheet system 100 of FIG. 1, but with the stakes 142 and anchor ties 146 removed. The netting 113 comprises a front side netting section 150 covering at least a portion of the front side 136 of the fiber sheet 112, a rear side netting section 152 covering at least a portion of the rear side 138 of the fiber sheet 112, and a top side netting section 154 covering the top side 124 of the fiber sheet 112 and connecting the rear side netting section 152 to the front side netting section 150. The netting 113 also comprises a left side netting section 156 covering at least a portion of the left side 130 of the fiber sheet 112 and connecting the front side netting section 150 to the rear side netting section 152, and a right side netting section 158 covering at least a portion of the right side 128 of the fiber sheet 112 and also connecting the front side netting section 150 to the rear side netting section 152. As shown in FIGS. 5-7, each of the top side netting section 154, the front side netting section 150, the rear side netting section 152, the left side netting section 156, and the right side netting section 158 cover the fiber sheet upper section 119. The fiber sheet lower section 117 is not covered by the netting 113, but, rather, extends beyond the netting 113, as the fiber sheet upper section 119 is covered on all sides by the netting 113.

The front side netting section 150 is aligned adjacent a fiber sheet upper section 119 and comprises a front side netting section edge 160 disposed at the bottom of the front side netting section 150. The front side netting section edge 160 is disposed above or distal from the lower front edge 133 of the fiber sheet 112 and intermediate between the lower front edge 133 and the upper front edge 135, thereby leaving a fiber sheet lower section 117 exposed and projecting downward beyond the netting 113. Likewise, the rear side netting section 152 is aligned adjacent the fiber sheet upper section 119 and comprises a rear side netting section edge 162. The rear side netting section edge 162 is disposed above or distal from the lower rear edge 127 of the fiber sheet 112, thereby leaving a fiber sheet lower section 117 exposed.

The front side netting section 150 comprises a front side netting band 161 extending along all or at least a portion of the front side netting section 150. The front side netting band 161 is aligned at or proximal to the front side netting edge 160. The front side netting band 161 generally comprises band threads and/or band webbing that exhibit a thread count that is greater than the average thread count of the rest of the front side netting section 150. The front side netting band 161 is constructed and aligned so as to potentially increase the strength and/or durability of the front side netting edge 160 and/or to server as a substrate for receiving cross ties.

Likewise, the rear side netting section 152 comprises a rear side netting band 163 extending along all or at least a portion of the rear side netting section 152. The rear side netting band 163 is aligned at or proximal to the rear side netting edge 162 and intermediate between the lower rear edge 127 and the upper rear edge 137. The rear side netting band 163 generally comprises band threads and/or band webbing that exhibit a thread count that is greater than the average thread count of the rest of the rear side netting section 152. The rear side netting band 163 also is constructed and aligned so as to potentially increase the strength and/or durability of the rear side netting edge 162 and/or to server as a substrate for receiving cross ties 157. Furthermore, the left side netting section 156 can comprise a left side netting band 165 extending between the rear side netting band 163 and the front side netting band 161, and the right side can comprise a right side netting band 167 extending between the rear side netting band 163 and the front side netting band 161. Accordingly, the netting 113 comprises a lower netting band 171 comprising the four side netting bands 161, 163, 165 and 167 that is aligned at the terminating edge of the netting 113 and that extends around the fiber sheet 112.

As shown in FIGS. 5 and 6, the front side netting section 150 comprises a front side netting weave 172, and the rear side netting section 152 comprises a rear side netting weave 174. In one aspect, the front side netting weave 172 exhibits a front side netting thread count less than the rear side netting thread count of the rear side netting weave 174. The thread counts exhibited by the netting weaves of the netting of the fiber sheet systems of the present disclosure can vary depending upon the application in which the fiber sheet system is intended to be used. In slope length shortening applications, heavy water flow typically is not experienced, whereas, in check dam applications concentrated heavy water flow usually is expected. Therefore, in slope length shortening applications, the thread counts of the netting weaves of the netting of the fiber sheet system can be low, and, in check dam applications, thread counts of the netting weaves will be higher. For example, in a slope length shortening application, the netting weave of the nettings 113 or 213 can be about 5 cm×5 cm. For the check dam application, the netting weave of the nettings 113 or 213 can be about 2.5 cm×2.5 cm.

In one aspect, the front side netting weave 172 can exhibit an average front side netting thread count in the range of about 0.1 to 1 per square centimeter, and the average rear side netting weave 174 can exhibit a rear side netting thread count in the range of about 0.25 to about 6 per square centimeter. In still another aspect, the rear side netting section 152 can comprise a plurality of reinforcement bands 176 spaced apart across the rear side netting section 152. The reinforcement bands 176 can be aligned both horizontally and vertically, and can intersect each other. While the more open front side netting weave 172 of the front side netting section 150 can allow for greater input of water flow into the fiber sheet 112, the tighter rear side netting weave 174 of the rear side netting section 152 can provide support for the fiber sheet 112 so as to maintain the shape and alignment of the fiber sheet 112 when exposed to water.

As shown in FIG. 7, the netting 113 also can comprises a plurality of cross ties 157 that extend through two opposing sides of the fiber sheet 112 and connect opposing sides of the netting 113. Each cross tie 157 comprises a first end that extends through the front side 136 of the fiber sheet 112 and is attached to the front side netting section 150, and a second end that extends through the rear side 138 of the fiber sheet 112 and is attached to the rear side netting section 152. The plurality of cross ties 157 secures the netting 113 to the fiber sheet 112.

As shown in FIGS. 1-4 and 9, the fiber sheet system 100 can comprise a first set of stakes 142 aligned adjacent the rear side 138 of the fiber sheet system segment 110 and a second set of stakes 142 aligned adjacent the front side 136 when installed on a ground surface. The two sets of stakes 142 cooperate with the fiber sheet system segment 110 to maintain the alignment of the fiber sheet system segment 110 in its original installed position during use. Staples can be inserted through the fiber sheet 112 and also into the surface of the soil 300 on which the fiber sheet system segment 110 is installed in order to assist in securing the fiber sheet system segment 110 in place.

Figure 9:
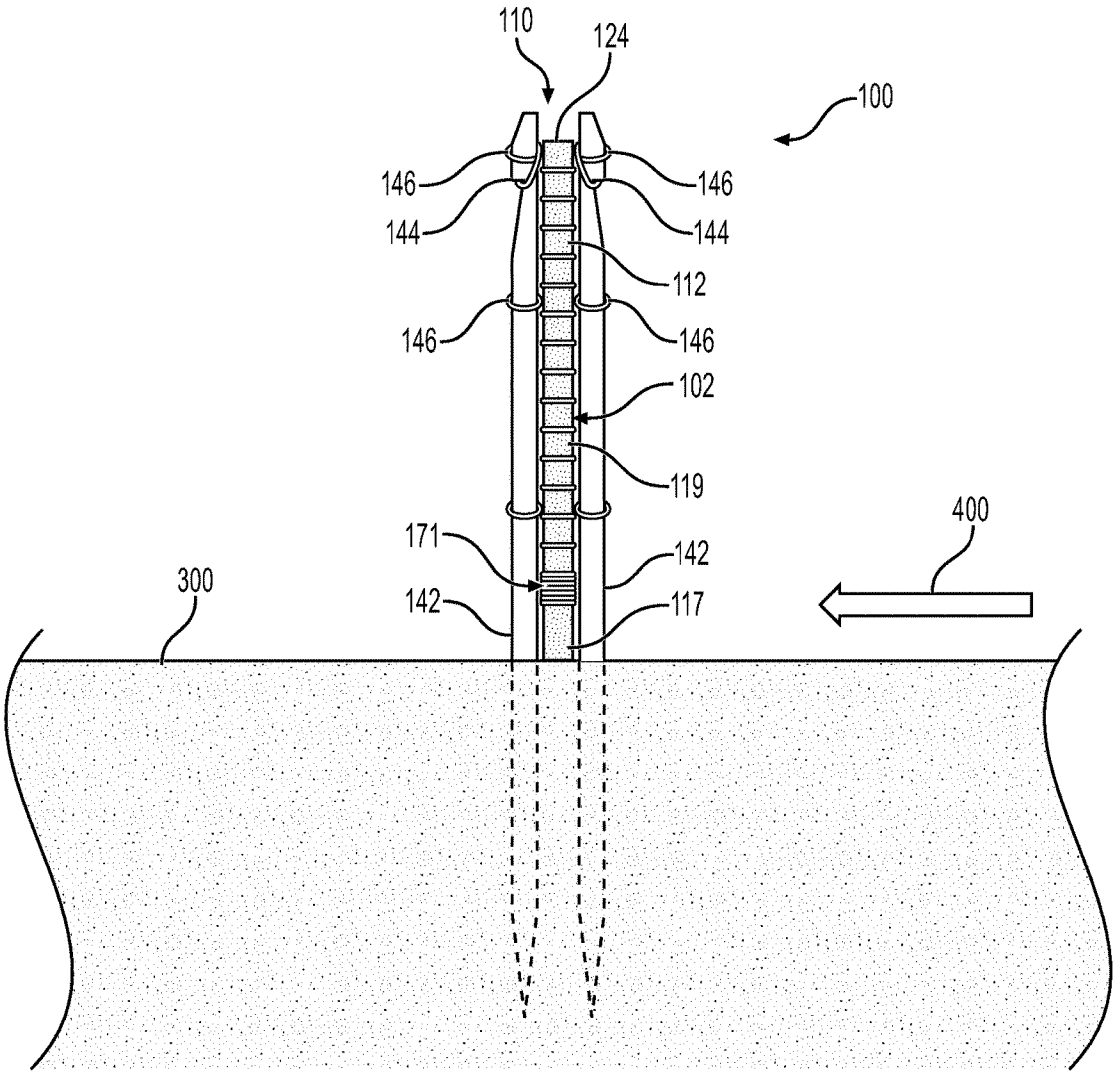
FIG. 9 is a left side view of the portion of the fiber sheet system of FIG. 1 installed on soil.
Figure 10:
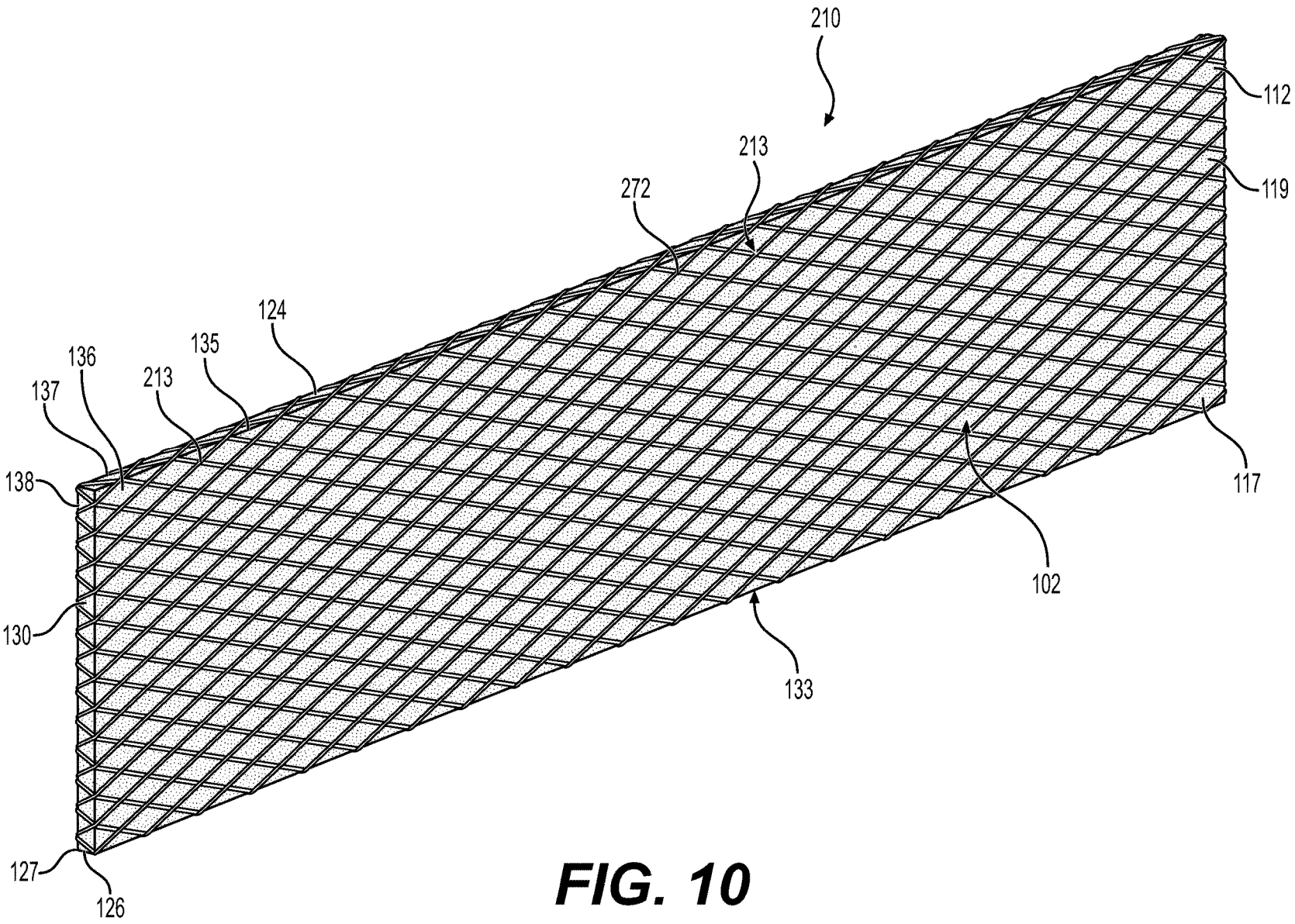
FIG. 10 is a perspective view of another fiber sheet system segment encompassing aspects of the present disclosure.
Figure 11:
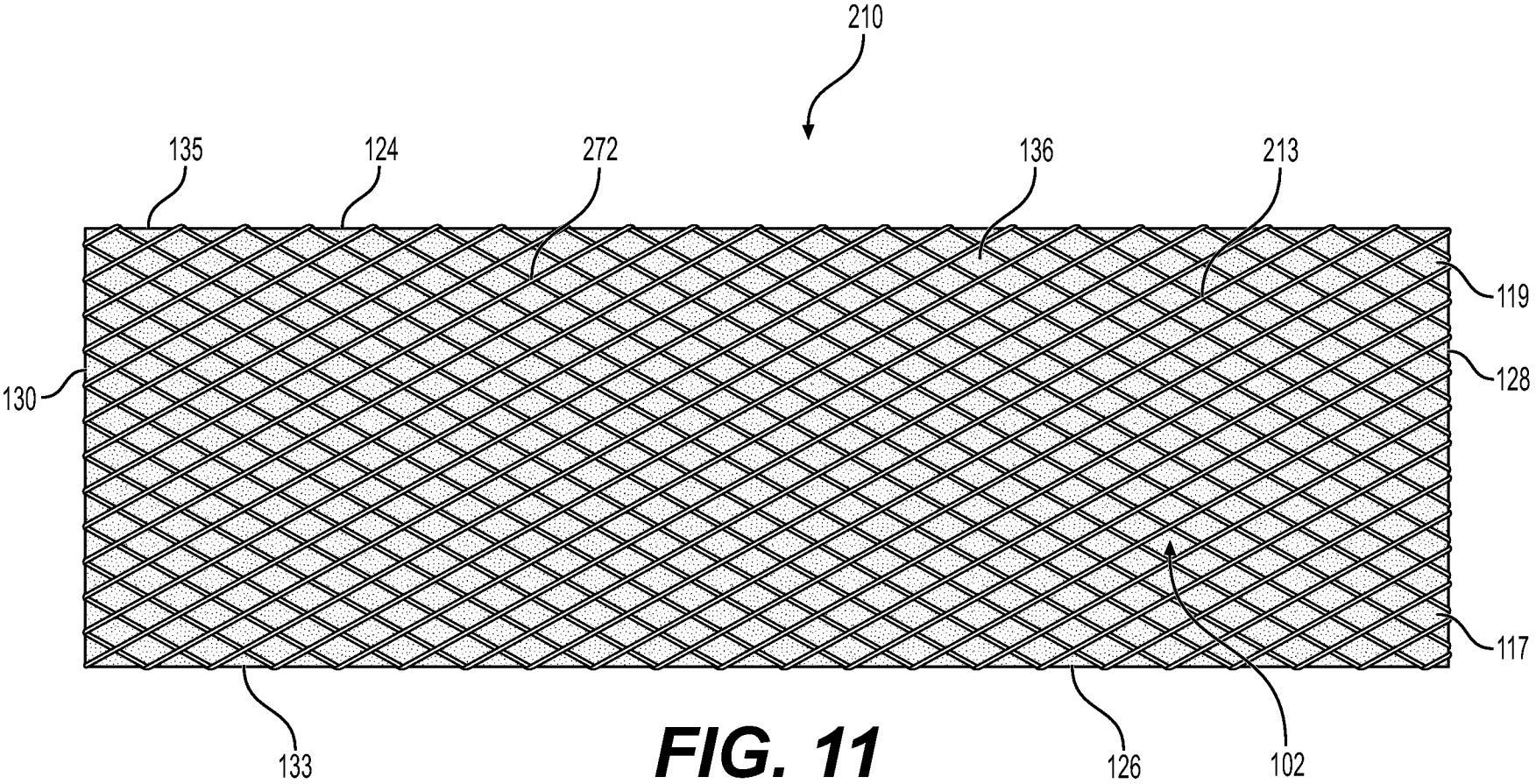
FIG. 11 is a front side view of the fiber sheet system segment shown in FIG. 10.
Figure 12:
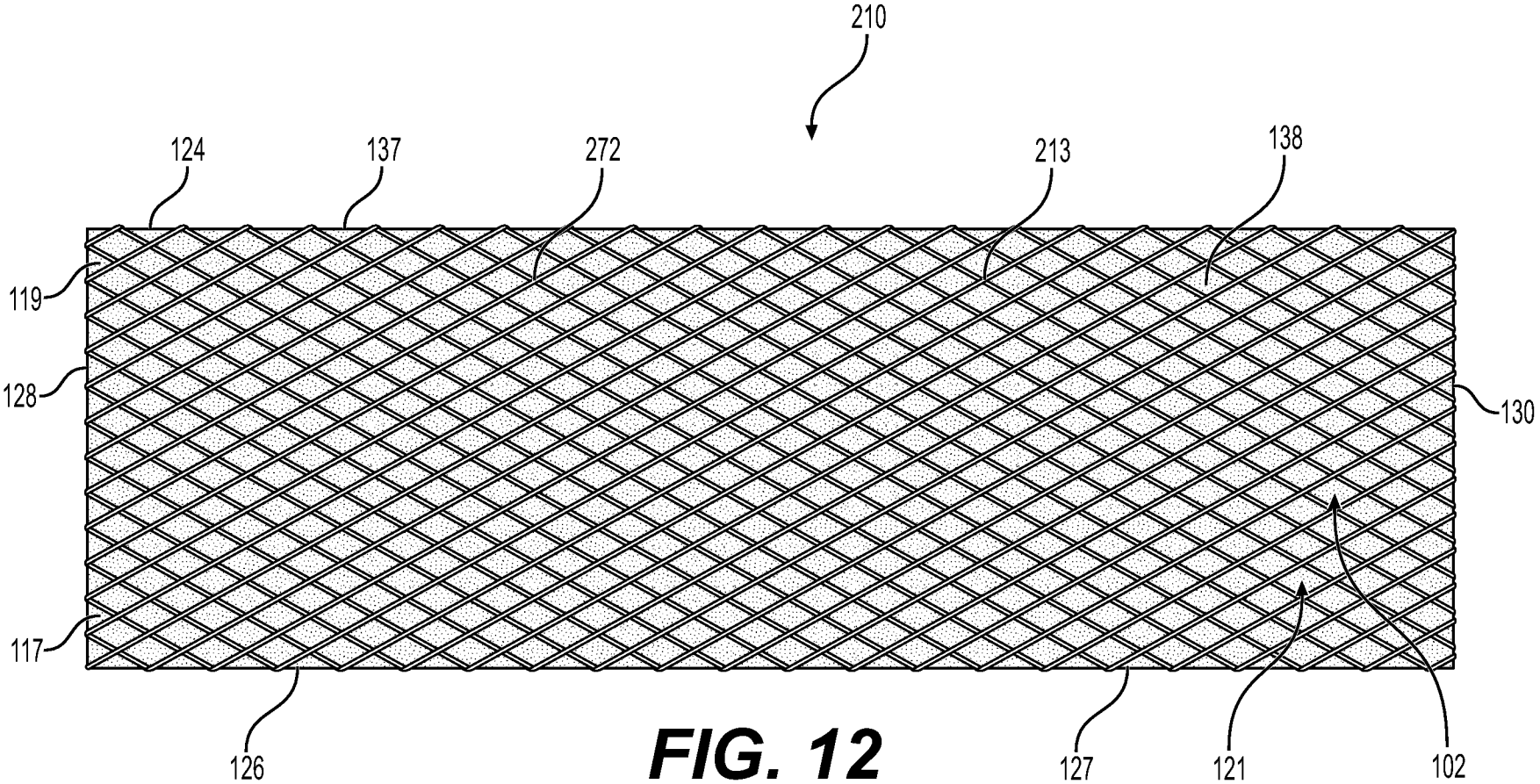
FIG. 12 is a rear side view of the fiber sheet system segment shown in FIG. 10.

FIG. 9 illustrates the fiber sheet system 100 in use as installed in soil aligned perpendicular to a water flow 400. The front side 136, with the coating composition 102 adhered thereto, of the fiber sheet 112 is installed facing the water flow 400 with the bottom side 126 of the fiber sheet 112 aligned on the soil surface 300. Each stake 142 is inserted in the ground to secure the fiber sheet system 100 in place. The anchor ties 146 are attached to the netting 113 and the stakes 142, thereby securing the fiber sheet system segment 110 to the stakes 142. The fiber sheet lower section 117 extends beyond the lower band 171 of the netting 113 and is disposed directly on the soil surface 300. When water flows 400 towards the front side 136 of the fiber sheet 112, silt that is carried by the water flow 400 tends to contact and be stopped by the fiber sheet system 100, thereby preventing silt from passing beyond the fiber sheet system 100. Since the fiber sheet 112 sits directly on the soil surface 300 without the netting 113 being disposed therebetween, the water flow 400 cannot flow under the fiber sheet 112. Silt will tend to accumulate on the front side 136 of the fiber sheet 112. Multiple fiber sheet segments 110 can be installed end to end to provide a continuous barrier to prevent silt movement or erosion. Alternatively, the coating composition 102 can be applied to the rear side 138 of the fiber sheet 112 and aligned on the opposing side of the fiber sheet system 100 away from the water flow 400. In such an alignment, the water flow 400 contacts first the coir fiber felt of the fiber sheet 112 as it diffuses through the fiber sheet 112.

FIGS. 10-14 illustrate another embodiment of a fiber sheet system segment 210 and another embodiment of a fiber sheet system 200 encompassing aspects of the present disclosure. The fiber sheet system 200 comprises a fiber sheet 112 formed of needle-punched coir felt 121 encased in a netting sleeve 213. The fiber sheet 112 has a coating composition 102 adhered to both the front side 136 and the rear side 138 thereof. Unlike the fiber sheet system 100 in which the fiber sheet lower section 117 is uncovered by the netting 113 and projects beyond the lower edge thereof, the entire fiber sheet 112, including the fiber sheet lower section 117, is encased in the netting sleeve 213. The mesh 214 of the netting sleeve 213 comprises a diamond weave 272 of coir twine that extends around each side of the fiber sheet 112. Alternatively, the fiber sheet 112 can have the coating composition 102 adhered to just one of the front side 136 or the rear side 138. In yet another alternative, the fiber sheet 112 can have the coating composition 112 adhered to substantially all of the fiber sheet 112.

Figure 13:
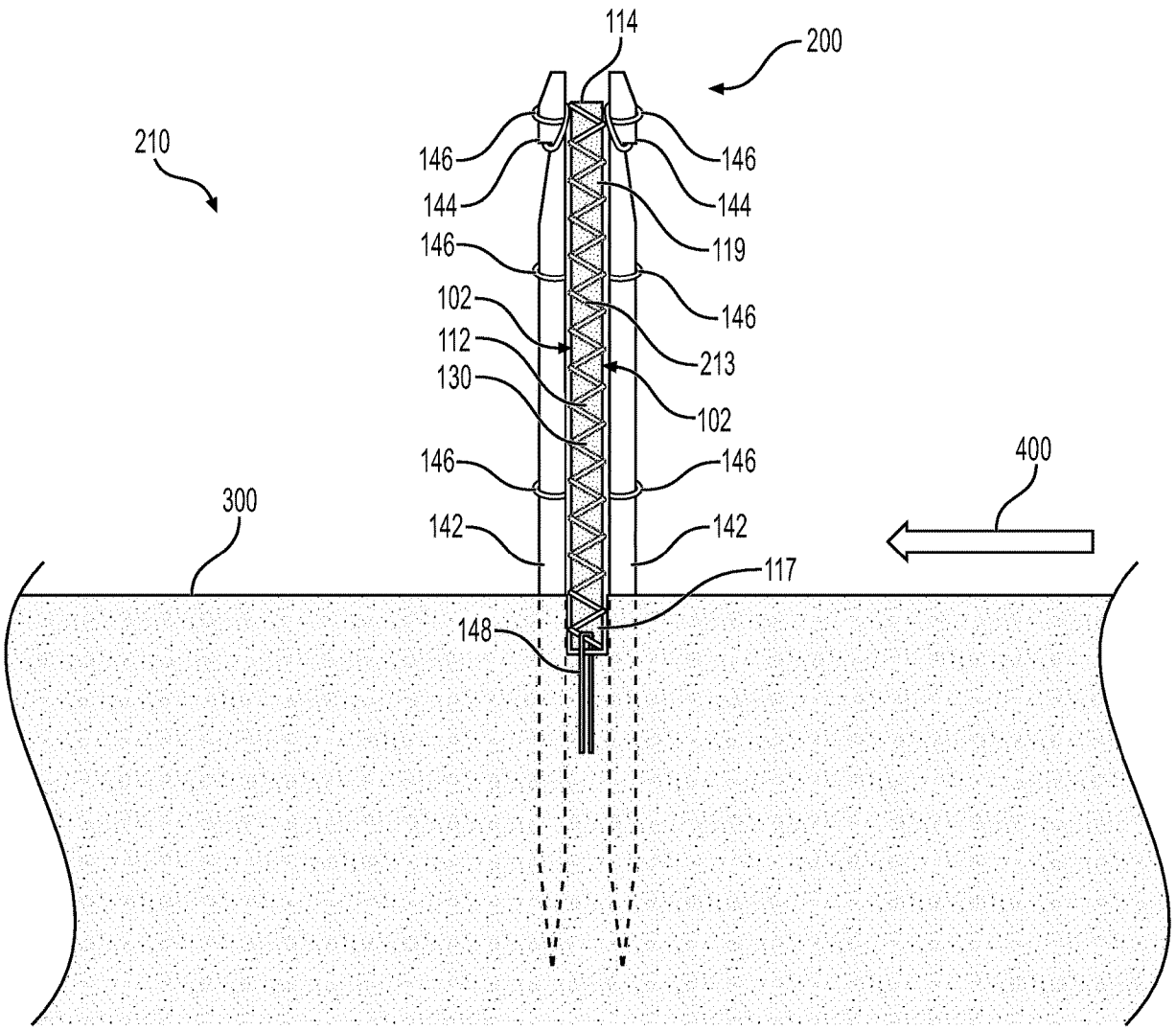
FIG. 13 is a left end view of the fiber sheet system segment shown in FIG. 10 incorporated in a fiber sheet system with a plurality of stakes and a plurality of staples attached to the fiber sheet system segment, wherein the fiber sheet system encompasses aspects of the present disclosure, wherein the fiber sheet system is installed in soil and with the lower portion of the fiber sheet system segment disposed in a channel formed in the soil.

FIG. 13 illustrates the fiber sheet system 200 in use as installed in soil aligned perpendicular to a water flow 400. The fiber sheet system 200 is anchored to the soil by a plurality of stakes 142 that are attached to the fiber sheet segment 210 by a plurality of anchor ties 146 that are attached to the sleeve 213 and/or directly to the fiber sheet 112. Each anchor tie 146 can be threadably attached to the netting sleeve 213, intertwined with the netting sleeve 213, and/or inserted through the fiber sheet 112. The fiber sheet system 200 is anchored to the soil also by a plurality of staples 148. Each staple 148 is interlocked with the netting sleeve 213 and driven into the soil at the bottom of a trench or channel cut into the soil and extending below the soil surface 300. The staples 148 are spaced about 30 cm apart along the length of the fiber sheet system 200. The staples 148 can be of varying size, such as about 10 cm to about 20 cm in length. The staples 148 of about 10 cm in length can be used in harder and more compact soil, whereas the longer staples 148 of about 20 cm in length can be used in softer and less compact soil. The trench or channel is cut to a depth of approximately 2 cm to 5 cm below the soil surface 300. The front side 136 of the fiber sheet 112 is installed facing the water flow 400 with the bottom side 126 of the fiber sheet 112 aligned below the soil surface 300. A portion of the fiber sheet lower section 117 of the fiber sheet 112 is disposed in the trench or channel. The trench is approximately the width of the fiber sheet segment 210 and deep enough to provide abutting surfaces to the front side 136 and rear side 138 of the fiber sheet 112 so as to secure the fiber sheet system segment 210 in place. The trench is shallow enough to allow a majority of the height of the fiber sheet system segment 210 to project upward above the surface of the soil so as to provide a barrier of sufficient height to block the movement of soil contained within water flows moving along the soil surface 300 and that might flow into the fiber sheet 212.

Each stake 142 is inserted in the soil of the ground to secure the fiber sheet system 200 in place. The anchor ties 146 are attached to the netting 213 and the stakes 142, thereby securing the fiber sheet 112 and netting 213 to the stakes 142. The fiber sheet lower section 117 is aligned below the soil surface 300 and anchored in the channel by the plurality of staples 148. When water flow 400 is towards the front side 136 of the fiber sheet 112, silt that is carried by the water flow 400 tends to contact and be stopped by the fiber sheet system 200, thereby preventing silt to pass beyond the fiber sheet system 200. Silt will tend to accumulate on the front side 136 of the fiber sheet 112.

Figure 14:
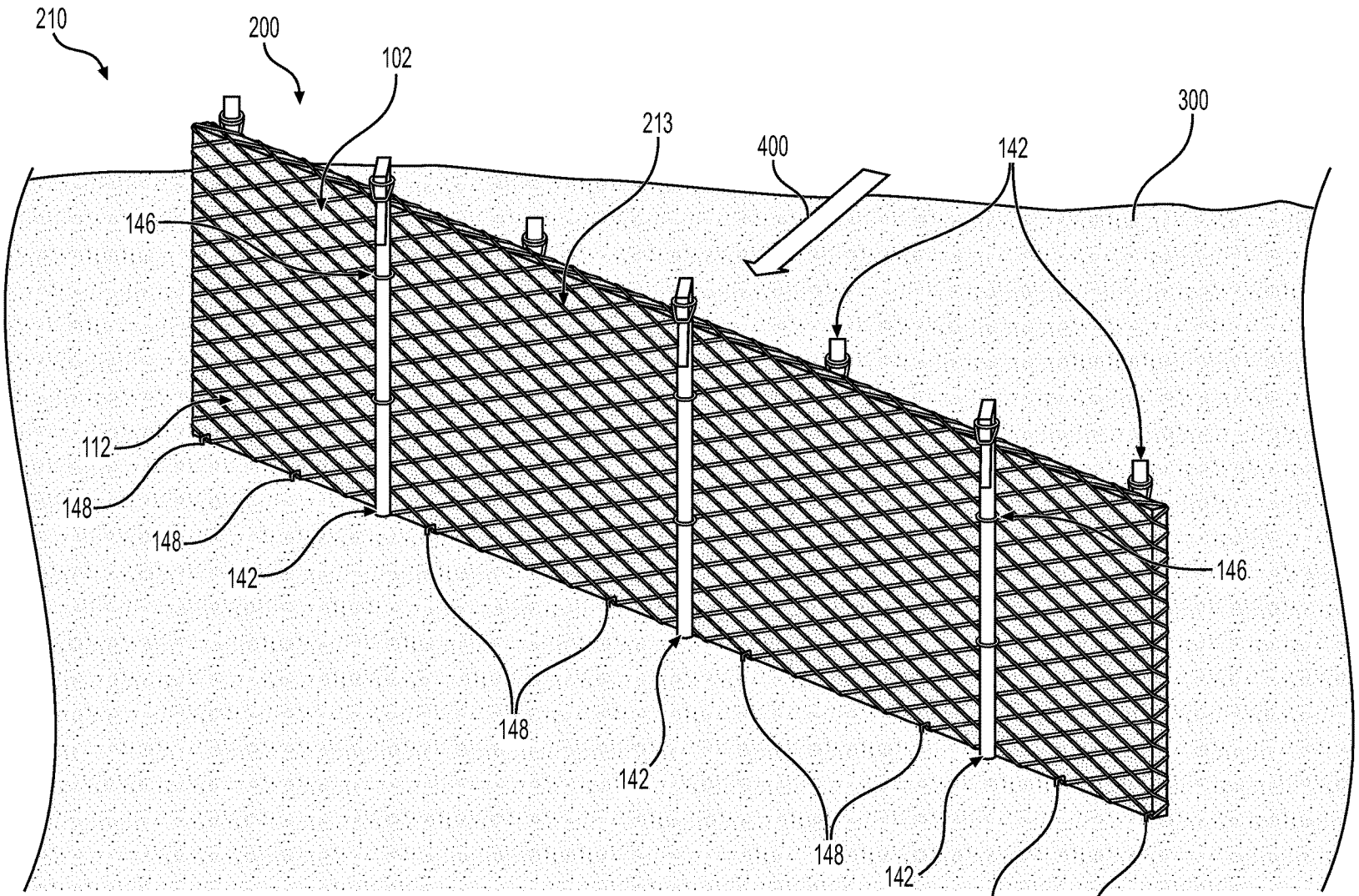
FIG. 14 is a perspective view of the fiber sheet segment shown in FIG. 10 incorporated into a fiber sheet system with a plurality of stakes and a plurality of staples attached to the fiber sheet system segment, wherein the fiber sheet system encompasses aspects of the present disclosure, wherein the fiber sheet system is installed in soil with the plurality of stakes and the plurality of staples securing the fiber sheet system segment to the soil surface.

FIG. 14 illustrates the fiber sheet system 200 in use in an alternative installation configuration. As in FIG. 13, the fiber sheet system 200 is installed in soil and aligned perpendicular to a water flow 400, but the installation does not include a trench. Instead, the fiber sheet system 200 is aligned on the soil surface 300 and anchored thereto with both a plurality of stakes 146 and a plurality of staples 148. Each staple 148 engages a lower portion of the netting 213, thereby securing the netting 213 and the entire fiber sheet 112 to the soil surface 300. The securing of the fiber sheet system 200 to the soil surface 300 with the plurality of staples 148 can minimize and/or prevent the sediment-laden water of the water flow 400 from flowing under the fiber sheet 112. The front side 136 of the fiber sheet 112 is installed facing the water flow 400 with the bottom side 126 of the fiber sheet 112 aligned below the soil surface 300. The staples 148 can be formed of a metal, such as carbon steel or stainless steel, or other suitable material. The present disclosure also encompasses fiber sheet systems 100 that use the plurality of staples 148 in installations using a trench, as shown in FIG. 9.

The coir fiber felt 121 of the fiber sheet 112 can serve as a filter media for sediment-laden water. The average pore size of the coir fiber felt 121 tends to be smaller than the average pore size of compressed coir fiber blocks that are not a needle-punched felt. Adherence of the coating composition 102 to the coir fiber felt 121 further reduces the thickness or width of the fiber sheet 112 and can, depending upon the amount of the coating composition 102 applied to the fiber sheet 112, reduce the average pore size of the coir fiber felt 121, thereby reducing the flow rate of filtered water passing through the fiber sheet 112. Since natural rubber tends to degrade when exposed to ultraviolet light, the coating composition 102 can tend to degrade after the fiber sheet system 100 is installed in an erosion control installation. As the coating composition 102 degrades over time, the coir fiber felt 121 of the fiber sheet 112 may tend to expand. During this time of expansion, the fiber sheet 112 may have tended to accumulate sediment therein from sediment-filled water passing therethrough. The accumulated sediment may tend to block the pores of the coir fiber felt 121, thereby providing additional surface area for filtration of the sediment-filled water that continues to pass therethrough.

The fiber sheet 112 can have height-to-width ratio of a height from the top side 124 to the bottom side 126 greater to a width of the fiber sheet 112 from front side 136 to rear side 138 in the range of about 9 to 1 to about 90 to 1. In one aspect, the front side 136 of the fiber sheet 112 can be about 23 cm in height and the top side 124 can be about 0.5 cm in width. In another aspect, the front side 136 of the fiber sheet 112 can be about 30 cm in height and the top side 124 can be about 0.5 cm in width. In yet another aspect, the front side 136 of the fiber sheet 112 can be about 45 cm in height and the top side 124 can be about 0.5 cm in width. In a further aspect, the front side 136 of the fiber sheet 112 can be about 23 cm in height and the top side 124 can be about 1.25 cm in width. In still another aspect, the front side 136 of the fiber sheet 112 can be about 30 cm in height and the top side 124 can be about 1.25 cm in width. In yet another aspect, the front side 136 of the fiber sheet 112 can be about 45 cm in height and the top side 124 can be about 1.25 cm in width. In one aspect, the front side 136 of the fiber sheet 112 can be about 23 cm in height and the top side 124 can be about 2.5 cm in width. In another aspect, the front side 136 of the fiber sheet 112 can be about 30 cm in height and the top side 124 can be about 2.5 cm in width. In yet another aspect, the front side 136 of the fiber sheet 112 can be about 45 cm in height and the top side 124 can be about 2.5 cm in width.

In one aspect, the ratio of the front side height 159 of the fiber sheet 112 to the top side width 149 can be about 9 to 1. In another aspect, the ratio of the front side height 159 of the fiber sheet 112 to the top side width 149 can be about 12 to 1. In a further aspect, the ratio of the front side height 159 of the fiber sheet 112 to the top side width 149 can be about 18:1. In still another aspect, the ratio of the front side height 159 of the fiber sheet 112 to the top side width 149 can be about 24 to 1. In a further aspect, the ratio of the front side height 159 of the fiber sheet 112 to the top side width 149 can be about 36 to 1. In yet another aspect, the ratio of the front side height 159 of the fiber sheet 112 to the top side width 149 can be about 45 to 1. In another aspect, the ratio of the front side height 159 of the fiber sheet 112 to the top side width 149 can be about 60 to 1. In a further aspect, the ratio of the front side height 159 of the fiber sheet 112 to the top side width 149 can be about 90 to 1.

Figure 15:
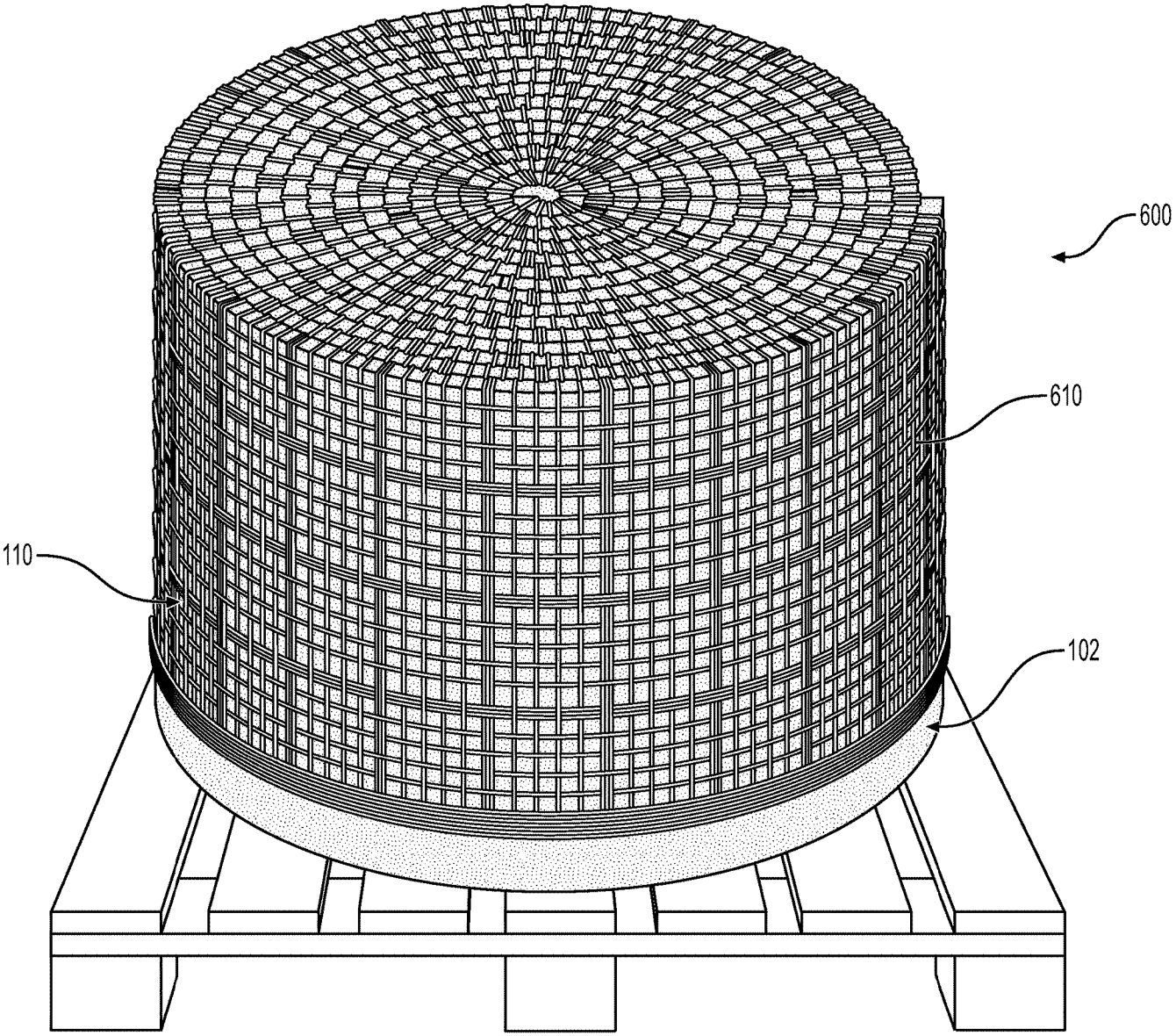
FIG. 15 is a perspective view of a fiber sheet system coil disposed on a pallet, wherein the fiber sheet system coil is formed of one or more of the fiber sheet system segments as shown in FIG. 5 joined together in a fiber sheet system chain.

FIG. 15 illustrates a fiber sheet system chain 600 rolled into a coil and disposed on a pallet. The fiber sheet system chain coil 610 can be formed from one or more fiber sheet system chains 600. Each fiber sheet system chain 600 can be formed from one or more fiber sheet system segments 110 connected end-to-end with each other. The present disclosure also encompasses a fiber sheet system chain, not shown, comprises of a plurality of fiber sheet system segments 210 connected end-to-end with each other. The fiber sheet system chain 600 can be used as unitary piece in a sediment control application or shortened as needed by removing one or more fiber sheet system segments 110 therefrom. The fiber sheet system segments 110 can be stored and/or transported more efficiently by rolling the fiber sheet system chain 600 into a fiber sheet system chain coil 610. Since the fiber sheet 112 of each fiber sheet system segment 110 has a narrow width, each fiber sheet system chain coil 610 can include more linear meters of fiber sheet system segments 110, than if the fiber sheet system segments 110 were formed of fiber blocks having greater widths and smaller ratios of height-to-width than the height-to-width ratios of the fiber sheets 112 of the present disclosure. More than one fiber sheet system chain coil 610 can be stacked one on top of another on a pallet to reduce the space required to store and/or transport a given number of fiber system segments 110.

The fiber sheet system segments 110 and 210 can be constructed by feeding loose coir fibers into a needle punch machine. The loose coir fibers are compressed and entangled to cause the them to bind together to form a coir fiber felt 121. The coir fiber felt 121 is then fed to a sprayer which sprays a layer of the coating composition 102, comprising a natural latex, on either one or both of the front and back sides of the coir fiber felt 221. The coated coir fiber felt 121 is then fed through a double-roller press wherein the thickness of the coated coir fiber felt 221 is reduced. The pressed and coated coir fiber felt 221 is then fed to a continuous dryer wherein the felt is heated to a temperature in the range of about 80° C. to about 100° C. for about 30 minutes. The heating and drying process tends to cause the water contained in the coating composition 102 to evaporate and the remaining natural rubber and other constituents of the natural latex to interlock and/or to cross-link and/or to thermoset, thereby adhering the coating composition 102 with itself and the compressed coir fibers of the coated coir fiber felt 221. The pressing and heating of the coir fiber felt 121 tends to reduce its thickness or width, thereby allowing the fiber sheet 112 to have a width smaller than the width of the uncoated coir fiber felt 121.

The coated coir fiber felt 221 can be cut to the desired height and length to form the fiber sheet 112 with the coating composition 102 adhered thereto. For fiber sheet system segment 110, the netting 113 can be wrapped around the fiber sheet 112 and secured to the fiber sheet 112 by inserting cross-ties 157 into the fiber sheet 112 and securing the cross-ties 157 to either front side and rear side of the netting 113. Alternatively, for fiber sheet system segment 210, the fiber sheet 112 can be inserted into a netting sleeve 213 that, in turn, can then be tightened around the fiber sheet 112 and stitched at the left and right sides 130 and 128 of the fiber sheet 112 to completely encase the fiber sheet 112.

The fiber sheet systems 100 and 200 each can be installed as illustrated and used in erosion control sediment control, perimeter sediment control, slope length shortening, and/or check dam formation applications. The fiber sheet systems 100 and 200 can be installed and aligned so as to form a barrier to existing or potential water flows that may contain sediment or other solids. The fiber sheet systems 100 and 200 can act to remove or reduce the amount of sediment and other solids within the water flows so as to reduce the extent of possible erosion or introduction of the solids into a body of water.

The various alignments of the components of the fiber sheet system segments and the fiber sheet systems disclosed herein can be combined in alternative arrangements of fiber sheet system segments and fiber sheet systems encompassed by the present disclosure. Other embodiments of the present disclosure will be apparent to those skilled in the art from their consideration of the specification and practice of the present disclosure disclosed in this document. The applicant intends that the specification and examples be considered as exemplary only, with the true scope and spirit of the present disclosure being indicated by the following claims.

What is claimed is:

1. A fiber sheet system for perimeter sediment control, slope length shortening, and check dam applications, the fiber sheet system comprising:

a fiber sheet comprising a natural fiber felt wherein the natural fiber felt exhibits an area density in the range of about 1.25 kg/m$^2$ to about 1.56 kg/m$^2$, wherein the fiber sheet comprises a top side, a bottom side opposing the top side, a front side extending between the top side and the bottom side, a rear side opposing the front side and extending between the top side and the bottom side, a right side extending between the front side and the rear side, and a left side opposing the right side;

a coating composition adhered to the fiber sheet. wherein the coating composition comprises a natural rubber, wherein the natural rubber comprises a polyisoprene moiety, wherein the coating composition exhibits an area density in the range of about 0.06 kg/m$^2$ to about 0.22 kg/m$^2$; and, a netting attached to the fiber sheet, wherein the netting comprises a natural fiber mesh.

2. A fiber sheet system for perimeter sediment control, slope length shortening, and check dam applications, the fiber sheet system comprising:

a fiber sheet comprising a natural fiber felt wherein the natural fiber felt exhibits an area density in the range of about 1.25 kg/m$^2$ to about 1.56 kg/m$^2$, wherein the fiber sheet comprises a top side, a bottom side opposing the top side, a front side extending between the top side and the bottom side, a rear side opposing the front side and extending between the top side and the bottom side, a right side extending between the front side and the rear side, and a left side opposing the right side;

a coating composition adhered to the fiber sheet, wherein the coating composition comprises a natural rubber, wherein the natural rubber comprises a polyisoprene moiety, wherein the coating composition exhibits an area density in the range of about 0.07 kg/m$^2$ to about 0.1 kg/m$^2$; and, a netting attached to the fiber sheet, wherein the netting comprises a natural fiber mesh.

3. A fiber sheet system for perimeter sediment control, slope length shortening, and check dam applications, the fiber sheet system comprising:

a fiber sheet comprising a natural fiber felt, wherein the fiber sheet comprises a top side, a bottom side opposing the top side, a front side extending between the top side and the bottom side, a rear side opposing the front side and extending between the top side and the bottom side, a right side extending between the front side and the rear side, and a left side opposing the right side;

a coating composition adhered to the fiber sheet, wherein the coating composition comprises a natural rubber, wherein the natural rubber comprises a polyisoprene moiety; and, a netting attached to the fiber sheet, wherein the netting comprises a natural fiber mesh, wherein the fiber sheet comprises a fiber sheet upper section and a fiber sheet lower section, wherein the fiber sheet upper section is covered by the netting, and wherein the fiber sheet lower section extends beyond a lower edge of the netting.

4. The fiber sheet system of claim 3, wherein the netting comprises a band, wherein the band is aligned adjacent the lower edge of the netting.

5. A fiber sheet system for perimeter sediment control, slope length shortening, and check dam applications, the fiber sheet system comprising:

a fiber sheet comprising a natural fiber felt, wherein the fiber sheet comprises a top side, a bottom side opposing the top side, a front side extending between the top side and the bottom side, a rear side opposing the front side and extending between the top side and the bottom side, a right side extending between the front side and the rear side, and a left side opposing the right side;

a coating composition adhered to the fiber sheet, wherein the coating composition comprises a natural rubber, wherein the natural rubber comprises a polyisoprene moiety; and, a netting attached to the fiber sheet, wherein the netting comprises a natural fiber mesh, wherein the netting comprises a front side netting section and a rear side netting section, wherein the front side netting section contacts the front side of the fiber sheet, wherein the rear side netting section contacts the rear side of the fiber sheet, wherein the front side netting section exhibits a front side netting thread count, and wherein the rear side netting section exhibits a rear side netting thread count, and wherein the rear side netting thread count is greater than the front side netting thread count.

6. The fiber sheet system of claim 5, wherein the rear side netting comprises a plurality of rear side netting bands.

7. A fiber sheet system for perimeter sediment control, slope length shortening, and check dam applications the fiber sheet system comprising:

a fiber sheet comprising a natural fiber felt, wherein the natural fiber felt exhibits an area density in the range of about 1.25 kg/m$^2$ to about 1.56 kg/m$^2$, wherein the fiber sheet comprises a top side, a bottom side opposing the top side, a front side extending between the top side and the bottom side, a rear side opposing the front side and extending between the top side and the bottom side, a right side extending between the front side and the rear side, and a left side opposing the right side, wherein a ratio of a front side height of the front side of the fiber sheet to a top side width of the top side of the fiber sheet is in a range of about 9 to 1 to about 90 to 1;

a coating composition adhered to the fiber sheet, wherein the coating composition comprises a natural rubber, wherein the coating composition exhibits an area density in the range of about 0.07 kg/m$^2$ to about 0.1 kg/m$^2$; and, a netting covering the fiber sheet, wherein the netting comprises a natural fiber mesh.

8. A fiber sheet system for perimeter sediment control, slope length shortening, and check dam applications, the fiber sheet system comprising:

a fiber sheet comprising coir fiber felt, wherein the coir fiber felt exhibits an area density in the range of about 1.25 kg/m$^2$ to about 1.56 kg/m$^2$, wherein the fiber sheet comprises a top side, a bottom side opposing the top side, a front side extending between the top side and the bottom side, a rear side opposing the front side and extending between and connected to the top side and the bottom side, a right side, and a left side opposing the right side, and wherein a ratio of a front side height of the front side of the fiber sheet to a top side width of the top side of the fiber sheet is in a range of about 9 to 1 to about 90 to 1;

a coating composition adhered to the fiber sheet, wherein the coating composition comprises a natural rubber, wherein the natural rubber comprises a polyisoprene moiety, wherein the coating composition exhibits an area density in the range of about 0.07 kg/m$^2$ to about 0.1 kg/m$^2$; and, a netting contacting the fiber sheet, wherein the netting comprises a sleeve, wherein the sleeve encases the fiber sheet, and wherein the sleeve comprises coir fibers.

* * * * *